US006437344B1

(12) United States Patent
Strawson

(10) Patent No.: US 6,437,344 B1
(45) Date of Patent: Aug. 20, 2002

(54) PRODUCT IRRADIATION DEVICE AND METHOD OF IRRADIATING PRODUCTS USING THE SAME

(75) Inventor: David G. Strawson, Adamstown, MD (US)

(73) Assignee: MPR Associates, Inc., Alexandria, VA (US)

( * ) Notice: Subject to any disclaimer, the term of this patent is extended or adjusted under 35 U.S.C. 154(b) by 0 days.

(21) Appl. No.: 09/382,338

(22) Filed: Aug. 25, 1999

(51) Int. Cl.[7] ..... G21K 5/10

(52) U.S. Cl. ..... 250/455.11; 250/453.11; 378/69

(58) Field of Search ..... 250/455.11, 454.11, 250/453.11; 378/69

(56) References Cited

U.S. PATENT DOCUMENTS

| | | | | |
|---|---|---|---|---|
| 1,876,737 A | 9/1932 | Opp | | 378/193 |
| 3,142,759 A | 7/1964 | Jefferson et al. | | 378/69 |
| 3,411,002 A | 11/1968 | Armel | | 378/69 |
| 3,454,761 A | 7/1969 | Brunner | | 378/69 |
| 3,641,342 A | 2/1972 | Armel et al. | | 378/69 |
| 3,686,502 A | 8/1972 | Sieber | | 250/492.1 |
| 4,066,907 A | 1/1978 | Tetzlaff | | 378/69 |
| 4,864,595 A | 9/1989 | Barrett | | 378/69 |
| 5,001,352 A | 3/1991 | Tetzlaff | | 250/453.11 |

*Primary Examiner*—Jack Berman

(57) ABSTRACT

A product irradiation device includes an enclosure and an irradiator shell disposed in the enclosure. The shell comprises a wall or walls enclosing an irradiation source and a transport channel extending from an inlet port to an outlet port of the shell. The enclosure has an entry opening, communicating with the inlet port, through which products are introduced in succession into the transport channel from external of the enclosure. The enclosure has an exit opening, communicating with the outlet port, through which products discharged in succession from the transport channel are transported to a location external of the enclosure, the exit opening being disposed at a location different from the entry opening. The shell has a non-moving transport surface defined by a surface or surfaces of the wall or walls and upon which the products are advanced in fixed increments through the transport channel past the irradiation source. A plurality of linear actuators are provided in or on the shell for advancing the products through the transport channel. A method of irradiating products includes the steps of introducing products in succession into a transport channel of an irradiator shell, moving the products relative to and upon a non-moving transport surface of the shell such that the products are moved past an irradiation source in the shell and discharging the products in succession through an outlet port of the shell disposed at a location different from the inlet port.

47 Claims, 3 Drawing Sheets

PRODUCT IRRADIATION DEVICE AND METHOD OF IRRADIATING PRODUCTS USING THE SAME

BACKGROUND OF THE INVENTION

1. Field of the Invention

The present invention relates to product irradiation devices and, more particularly, to irradiation devices for irradiating products prior to consumption and/or use and to methods of irradiating products using irradiation devices.

2. Brief Description of the Prior Art

It has become desirable to irradiate various types of products, such as medical products and food products, to enhance the quality of the products prior to consumption and/or use thereof. Irradiation of medical and food products has been recognized as an effective means of sterilizing such products. More typically, irradiation has been used for pasteurization of food products, including meat, poultry, produce, cereal and canned goods, to destroy harmful parasites, bacteria and other pathogens and microorganisms in the food products, thusly increasing their safety for human consumption while not necessarily eradicating all microorganisms. Irradiated food products have also been found to resist deterioration and to possess longer shelf lives. In the case of produce, such as onions and potatoes, irradiation has been found to inhibit the growth of undesired sprouts on the produce. In the case of meat, the need for irradiation has intensified in view of the prevalence of human disease contracted via consumption of contaminated meat.

In the field of product irradiation, the use of radioactive isotopes, electron beams and X-rays as the sources of radiation has been contemplated. Various devices have been proposed for irradiating products to enhance the quality thereof, as exemplified by U.S. Pat. No. 1,876,737 to Opp, U.S. Pat. No. 3,142,759 to Jefferson et al., U.S. Pat. No. 3,411,002 to Armel, U.S. Pat. No. 3,454,761 to Brunner, U.S. Pat. No. 3,641,342 to Armel et al., U.S. Pat. No. 3,686,502 to Sieber, U.S. Pat. No. 4,066,907 to Tetzlaff, U.S. Pat. No. 4,864,595 to Barrett and U.S. Pat. No. 5,001,352 to Tetzlaff. In particular, the Armel, Tetzlaff ('907) and Barrett patents contemplate the irradiation of foodstuffs, as well as animal feed and medical articles, to effect sterilization, to inhibit deterioration and to destroy bacteria. The Opp patent contemplates the in situ irradiation of vegetation in order to kill parasites. The Opp patent relates to X-ray irradiation while the remainder of the cited patents relate to radioactive isotope irradiation. The subject invention is based on employing radioactive isotopes to irradiate products, as opposed to electron beam (E-beam) or X-ray devices.

Prior art product irradiation devices employing radioactive isotopes possess numerous disadvantages and drawbacks. In particular, such prior art product irradiation devices typically rely on complex transport mechanisms for moving the products past irradiation sources within the irradiation devices. Such complex transport mechanisms typically include moving conveyors, platforms, monorails and/or elevators, for example, disposed in high radiation zones of the product irradiation devices. Such transport mechanisms take up valuable space, undesirably add weight and increase the complexity and cost of the product irradiation devices. In addition, exposure of the transport mechanisms to radiation presents significant maintenance and repair problems related to the impairment or degradation of the transport mechanisms due to radiation exposure and the difficulty involved in accessing the transport mechanisms within the high radiation zones. The transport mechanisms typically include numerous moving mechanical parts that require the presence of lubricants, such as oil or grease, in the high radiation zones, in which case maintenance requirements are significantly increased. Accordingly, prior art product irradiation devices are generally associated with frequent down times for troubleshooting and maintenance, during which normal operation of the product irradiation devices must be suspended.

Another drawback of many prior art product irradiation devices employing radioactive isotopes is that the products being irradiated are moved along complex or circuitous prescribed paths through the irradiation devices. In many prior art product irradiation devices, the products are moved in multiple columns and/or rows, are moved between successive levels or tiers and/or are transferred between different conveyors, platforms or other mechanical structures as they are moved along the prescribed paths. Furthermore, some prior art product irradiation devices require that the products be individually rotated, repositioned or reoriented in addition to being moved in the prescribed paths through the irradiation devices. The complexity of the prescribed paths for the products through the irradiation devices, as well as the mechanical structures associated with moving the products in the prescribed paths and/or rotating, repositioning or reorienting the products individually, greatly increase the risk of malfunction and damage to the products being irradiated. Furthermore, in some prior art product irradiation devices, the products to be irradiated must be placed in special containers or bins prior to entering the irradiation devices, thusly undesirably complicating the irradiation operations and adding to the cost thereof. Many prior art product irradiation devices also require very complex indexing and timing systems to effect movement of the products through the irradiation devices. In order to effect the necessary indexing and timing, many prior art product irradiation devices require the presence of a very large number of products or "dummy" products in the irradiation devices.

An additional disadvantage associated with some prior art product irradiation devices is that the product irradiation devices are extremely bulky, heavy and cannot be moved from place to place. In particular, some product irradiation devices are located remote from the sources, such as manufacturing or processing facilities, of the products to be irradiated. This requires that the products to be irradiated be brought to the product irradiation devices rather than the product irradiation devices being brought to the sources of the products. Furthermore, some prior art product irradiation devices have the additional drawback of permitting human access to the interiors of the product irradiation devices via entry and/or exit ports through which the products enter and/or exit the product irradiation devices. In some prior art product irradiation devices, the entry and exit ports are disposed adjacent or close to one another or at substantially the same location on the product irradiation devices, thusly creating the risk that non-irradiated products entering the irradiation devices and irradiated products exiting the irradiation devices will become intermingled or mixed up with one another. Accordingly, some products may be inadvertently passed through the irradiation devices more than once and other products may not be irradiated at all. Some prior product irradiation devices have as a disadvantage the requirement that the irradiation sources be located in a water pool when not in use. Consequently, the sources are undesirably subjected to thermal transients, and complex lifting/lowering devices are needed.

Accordingly, the need exists for a product irradiation device employing radioactive isotopes and wherein the number of moving mechanical parts and the prescribed path for the products through the irradiation device are simplified and minimized while allowing products to be continuously irradiated at or proximate their source with minimal maintenance and repair and without inadvertent intermingling of irradiated and nonirradiated products.

SUMMARY OF THE INVENTION

Accordingly, it is a primary object of the present invention to overcome the aforementioned disadvantages of prior product irradiation devices and prior methods of irradiating products using product irradiation devices.

Another object of the present invention is to move products relative to and along a non-moving transport surface within a product irradiation device such that the products are moved past an irradiation source within the product irradiation device.

A further object of the present invention is to utilize only a minimal number of hydraulic actuators to move products in a prescribed path through a product irradiation device.

An additional object of the present invention is to eliminate the presence of moving mechanical parts in a high radiation zone of a product irradiation device.

Yet another object of the present invention is to prevent intermingling or mixing of non-irradiated products entering a product irradiation device and irradiated products exiting the product irradiation device.

It is also an object of the present invention to introduce products to be irradiated into a product irradiation device through an entry opening of the product irradiation device and to discharge irradiated products from the product irradiation device through an exit opening of the product irradiation device, the exit opening being disposed at a location remote from the entry opening.

The present invention has as a further object to introduce products into a product irradiation device, to move the products through the product irradiation device and to discharge the products from the product irradiation device with a maximum external dimension of the products disposed parallel to a plane of an irradiation source within the product irradiation device.

Some of the advantages of the present invention are that personnel requirements for operation and/or maintenance of the product irradiation device are minimized, the product irradiation device does not require any on-site fabrication at the source of the products to be irradiated, standard, transportable enclosures may be used for the product irradiation device, no foundation work is required for the enclosure at the source of the products, no lubricants are present in the high radiation zone, the product irradiation device is entirely self-contained, the product irradiation device is capable of automatic operation with high radiation efficiency, products may be irradiated at their manufacturing or processing facilities, the product irradiation device is relatively small and light weight, the product irradiation device is transportable, products can be irradiated with or without the products being placed in special bins or containers for movement through the irradiation device, mechanical malfunctions are reduced or eliminated, suspensions in normal operation of the product irradiation device are reduced, human access to the interior of the product irradiation device is restricted, redundant interlocks and/or opening/closing mechanisms to prevent human access are not needed, all products receive the same total exposure to radiation, the product irradiation device may be provided with auxiliary equipment for lighting, cooling and/or heating, the auxiliary equipment does not require any supply, such as power, from the source of the products, no personnel are required within the processing facility to handle non-irradiated and irradiated products, personnel requirements are limited to monitoring system operations, periodic maintenance and periodic irradiation source replacement, the irradiation source, once installed, is not moved until replacement is necessary due to radioactive decay, and thermal transients associated with moving irradiation sources into and out of water pools are eliminated.

These and other objects, advantages and benefits are realized with the present invention as generally characterized in a product irradiation device including an enclosure and an irradiator shell disposed in the enclosure. The irradiator shell comprises a wall or walls enclosing an irradiation source and a transport channel. The shell has an inlet port communicating with the transport channel and through which products, prior to being irradiated, are introduced in succession into the transport channel. The shell has an outlet port, different from the inlet port, communicating with the transport channel and through which the products, subsequent to being irradiated, are discharged in succession from the transport channel. The shell has a non-moving transport surface defined by an interior surface or surfaces of the wall or walls and upon which the products are moved through the transport channel past the irradiation source, whereby the products are irradiated. The irradiation source is disposed in a plane, and the transport surface is disposed in a plane perpendicular to the plane of the source. A plurality of hydraulic actuators are provided in or on the shell for moving the products into, through and out of the transport channel in fixed increments with an external dimension of the products parallel to the plane of the source. The enclosure has an entry opening communicating with the inlet port and through which the products are introduced in the transport channel, via the inlet port, from external of the enclosure. The enclosure has an exit opening communicating with the outlet port and through which the products discharged from the transport channel, via the outlet port, are transported to a location external of the enclosure, the exit opening being disposed at a location remote from the entry opening.

A method of irradiating products according to the present invention comprises the steps of introducing products in succession into a transport channel of an irradiator shell via an inlet port of the shell, moving the products relative to and upon a non-moving transport surface of the shell to advance the products through the transport channel in fixed increments such that the products are moved past an irradiation source within the shell and are thereby irradiated, and discharging the products in succession from the transport channel via an outlet port of the shell disposed at a location different from the inlet port.

Other objects and advantages of the present invention will become apparent from the following description of the preferred embodiments taken in conjunction with the accompanying drawings, wherein like parts in each of the several figures are identified by the same reference characters.

DESCRIPTION OF THE PREFERRED EMBODIMENTS

Figures 1, 5:
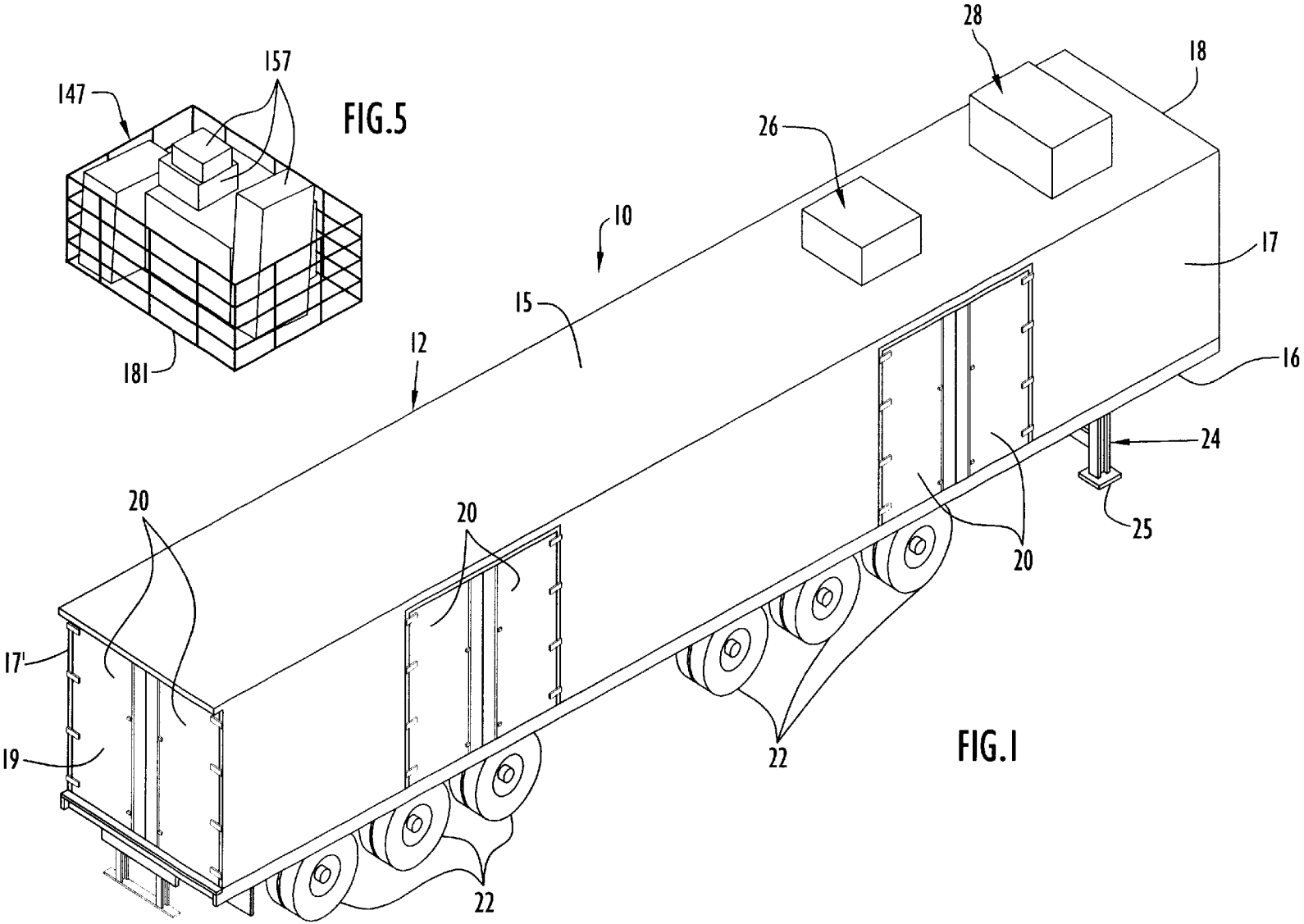
FIG. 1 is a perspective view of a product irradiation device according to the present invention.
FIG. 5 is a perspective view illustrating one of a plurality of baskets containing products to be irradiated.

A product irradiation device according to the present invention is illustrated at 10 in FIG. 1. The product irradiation device 10 includes a transportable or mobile enclosure 12 and an irradiator shell 14, illustrated in FIG. 2, disposed in enclosure 12. The enclosure 12 includes a top wall or roof 15, a bottom wall or floor 16, opposing side walls 17 and 17', a forward wall 18 and a rearward wall 19. In the case of enclosure 12, the walls 15, 16, 17, 17', 18 and 19 are flat or planar with top wall 15 parallel to bottom wall 16, side walls 17 and 17' parallel to one another and forward wall 18 parallel to rearward wall 19. A plurality of doors 20 are provided on enclosure 12, the doors 20 being selectively closeable to close the enclosure 12 and being selectively openable to present access openings communicating with the interior of enclosure 12.

As shown in FIG. 1, two pairs of doors 20 are hingedly mounted on side wall 17 with the doors 20 of each pair disposed next to one another or in side by side relation. Accordingly, each pair of doors 20, when open, presents an access opening on the side wall 17 corresponding or substantially corresponding in size to the height and the combined widths of the doors 20. The pairs of doors 20 are disposed at spaced locations along side wall 17 such that the access openings presented thereby are also spaced from one another. Another pair of doors 20 defines the rearward wall 19, the doors of the another pair being hingedly mounted to side walls 17 and 17', respectively, at a rearward end of the enclosure 12 as shown in FIG. 1. When the another pair of doors 20 defining rearward wall 19 are open, an access opening circumscribed by the top, bottom and side walls is presented at the rearward end of the enclosure 12. At least one additional pair of doors 20 (not visible in FIG. 1) is provided on side wall 17', the at least one additional pair of doors 20 being aligned with one of the pairs of doors 20 on side wall 17. In the case of enclosure 12, the rearwardmost pair of doors 20 on side wall 17 is aligned, in a direction transverse or perpendicular to a longitudinal axis of enclosure 12, with the at least one additional pair of doors 20 on side wall 17'. The access opening presented when the rearwardmost pair of doors 20 on side wall 17' are open serves as an exit or discharge opening for exit or discharge of irradiated products from the product irradiation device 10. The access opening presented when the at least one additional pair of doors on side wall 17 are open serves as an entry opening for introduction or entry of non-irradiated products into the product irradiation device 10. The doors 20 may be mounted on the enclosure 12 singly or in pairs depending on the sizes of the doors and the sizes desired for the access openings. Preferably, at least some of the access openings are of a size to permit human access and the introduction of necessary equipment into the interior of the enclosure. Doors 20, arranged singly or in pairs, may be provided on any or all walls of the enclosure. The doors 20 may be provided with latches or locks for locking the doors in a closed position, and such latches or locks may be conventional. Although the doors are disclosed herein as being hingedly mounted on the enclosure, it should be appreciated that the doors can be mounted on the enclosure in various other ways, such as being slidably mounted on the enclosure.

The enclosure 12 is mounted or supported on a plurality of wheels 22 by which the enclosure 12 can be transported along the ground or other surface. The enclosure 12 is mounted on six sets of wheels 22 as shown in FIG. 1. Three sets of wheels 22 are disposed adjacent or proximate the rearward end of the enclosure 12 while another three sets of wheels 22 are disposed intermediate the rearward end and a forward end of the enclosure 12. The three sets of wheels 22 disposed adjacent or proximate the rearward end are rearwardly spaced from the three sets of wheels 22 disposed intermediate the forward and rearward ends. No wheels 22 are provided at, adjacent or proximate the forward end since the forward end of enclosure 12 is adapted to be removably coupled to a powered wheeled vehicle (not shown) by which the enclosure 12 is transported along the ground or other surface. Apparatus and/or structure for coupling the enclosure 12 to a powered wheeled vehicle may be conventional in nature, such as that employed in conventional truck trailer design whereby the forward end of the enclosure 12 is supported upon one or more sets of wheels of the powered wheeled vehicle.

The enclosure 12 is provided with a selectively extendable, selectively retractable rigid brace or support 24 for supporting the forward end of the enclosure when the enclosure is not coupled to the powered wheeled vehicle. FIG. 1 shows the support 24, which is located at, adjacent or proximate the forward end of enclosure 12, extended beneath the bottom wall 16 in a direction perpendicular thereto. When the support 24 is thusly extended, a pair of feet 25 of the support 24 engage the ground or other surface upon which the wheels 22 are disposed, only one foot 25 being visible in FIG. 1. The support 24 supports the forward end of the enclosure 12 so that the enclosure 12 is in a level, horizontal position and prevents movement of the enclosure 12 upon the ground or other surface. Of course, the enclosure 12 may also be provided with a suitable brake for preventing movement of the enclosure 12 upon the ground or other surfaces. When the support 24 is retracted, the feet 25 do not engage the ground or other surface and movement of the enclosure 12 thereupon via the wheels 22 is permitted.

Preferably, the enclosure 12 is a standard truck trailer, as shown in FIG. 1, capable of being coupled to a truck by which the truck trailer is transported. It should be appreciated, however, that other standard enclosures, such as a rail car or a transportable container, may be used for enclosure 12. The enclosure 12 is capable of being transported or delivered to a loading dock or other suitable location at a manufacturing or processing facility or other source of products to be irradiated with the product irradiation device 10. Once delivered to the desired location, the enclosure 12 is detached from the truck and is parked, as shown in FIG. 1, without requiring any foundation work or other onsite construction or fabrication. The enclosure 12 can be provided with a plurality of braces 24 at various locations along the floor 16 thereof. Accordingly, once the enclosure 12 has been delivered to the desired location, the wheels 22 can be removed therefrom and the enclosure can be supported entirely by the plurality of braces 24. Of course, the braces 24 should be considered illustrative in that various support structure can be used to support the enclosure, with or without removal of the wheels 22.

The product irradiation device 10 is entirely self-contained in that all systems needed to operate the product irradiation device, as well as auxiliary equipment therefor, and to accomplish irradiation of products therewith are provided in or on the product irradiation device and do not require any integration with or supply of power from the manufacturing or processing facility or other source of the products to be irradiated. Equipment for various purposes, such as electricity generation, refrigeration, heating, ventilation and/or cooling (HVAC) and any other necessary or optional service, and the systems for operating such equipment, are provided in or on the enclosure 12. FIG. 1 illustrates enclosure 12 provided with a generator module 26 and an HVAC module 28, both of which are mounted or supported on the top wall 15 of the enclosure 12. The generator module 26 is used to generate electricity for various purposes, while the HVAC module 28 is used for heating, ventilation and/or cooling of the shell 14 and/or the enclosure 12 as well as for removing heat from an irradiation source disposed in shell 14 as explained further below. The HVAC module 28 can include a suitable compressor or other equipment capable of refrigerating the interior of the shell 14 and/or the interior of enclosure 12 where the products to be irradiated require refrigeration, as in the case of frozen products.

Figure 2:
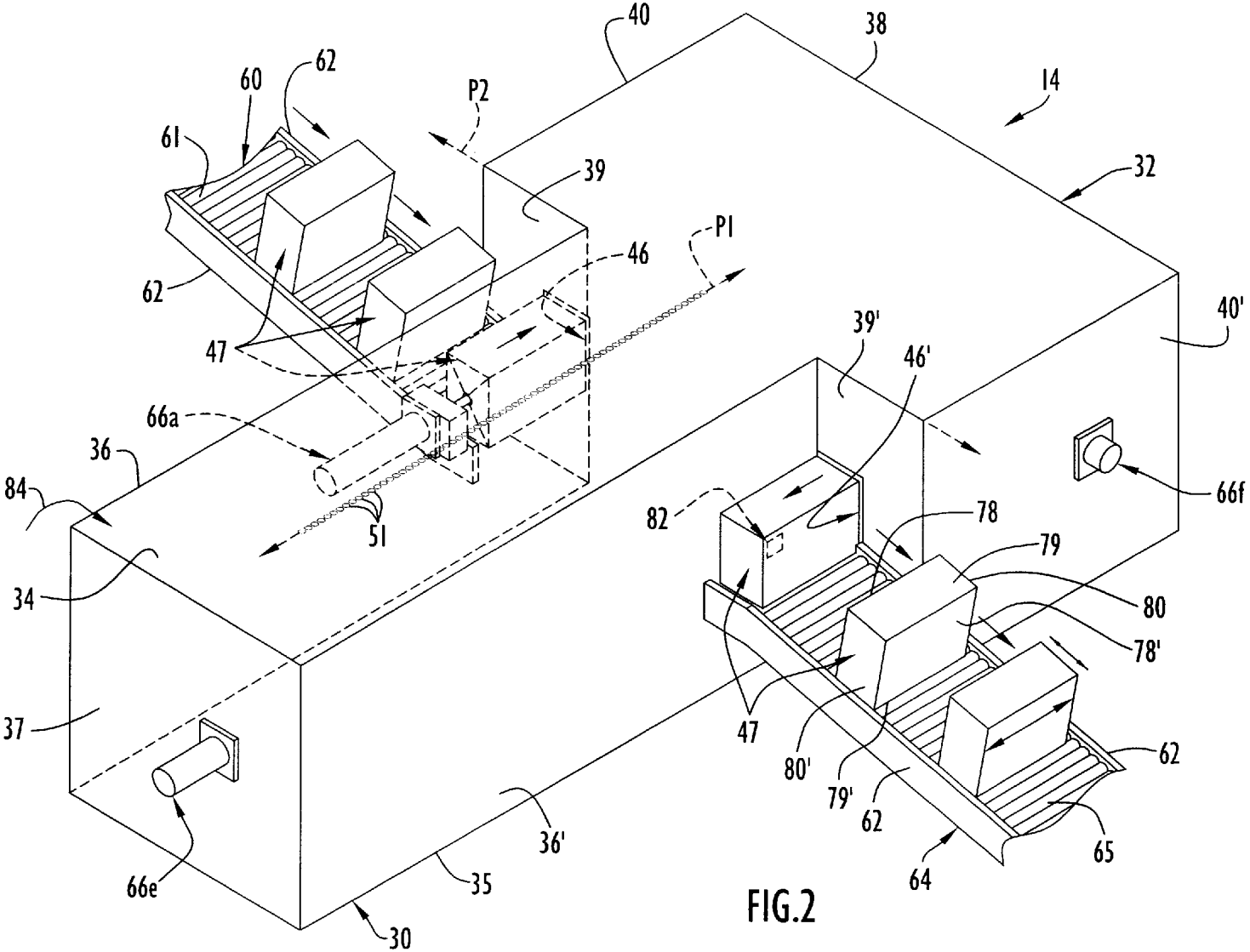
FIG. 2 is a perspective view of an irradiator shell of the product irradiation device.

The irradiator shell 14 is disposed entirely within the interior of enclosure 12. The external size of irradiator shell 14 is smaller in size than the interior of enclosure 12, and the portion of the interior of enclosure 12 not occupied by irradiator shell 14 is used to accommodate equipment necessary or useful for operation of the product irradiation device 10. In the case of product irradiation device 10, the irradiator shell 14 has an external configuration and size to fit within the interior of a standard truck trailer, i.e. enclosure 12. The irradiator shell 14 is shielded to minimize or prevent exposure of operating personnel, the public and the environment to ionizing radiation. Accordingly, it is preferred that the irradiator shell 14 be at least partly made of radiation impenetrable or absorbable material, such as steel or lead, forming a wall or walls enclosing an irradiation source and a product transport channel circumscribed or defined by an interior surface or surfaces of the wall or walls of the irradiator shell. The interior surface or surfaces defining the product transport channel are preferably made of stainless steel, as are exterior or visible surfaces of the shell 14, while the bulk of the shell 14 is made of less costly carbon steel or lead. The irradiator shell 14 has a generally T-shaped external configuration with a longitudinal shell section 30 and a transverse shell section 32 joined to and extending perpendicularly to the longitudinal shell section 30. Preferably, the longitudinal and transverse shell sections each have a square or rectangular external cross-sectional configuration, although other external cross-sectional configurations are possible. As shown in FIG. 2, the longitudinal shell section 30 has a square external cross-sectional configuration, and the transverse shell section has a rectangular external cross-sectional configuration.

The longitudinal shell section 30 is defined by a planar upperwall 34, a planar lower wall 35 parallel to upper wall 34, a pair of planar, parallel side walls 36 and 36' extending between upper wall 34 and lower wall 35 and a planar end wall 37. The transverse shell section 32 is defined by the planar upper wall 34, the planar lower wall 35, a planar side wall 38 extending between upper wall 34 and lower wall 35, a pair of planar side wall segments 39 and 39' parallel to side wall 38 and a pair of planar end walls 40 and 40'. The side wall segments 39 and 39', one of which is disposed on each side of the longitudinal shell section 30, extend between upper wall 34 and lower wall 35 and also extend between side walls 36 and 36' and end walls 40 and 40', respectively. The end wall 37 is parallel to the side wall 38 and the side wall segments 39 and 39'. The side walls 36 and 36' are parallel to the end walls 40 and 40'.

Figures 3, 4:
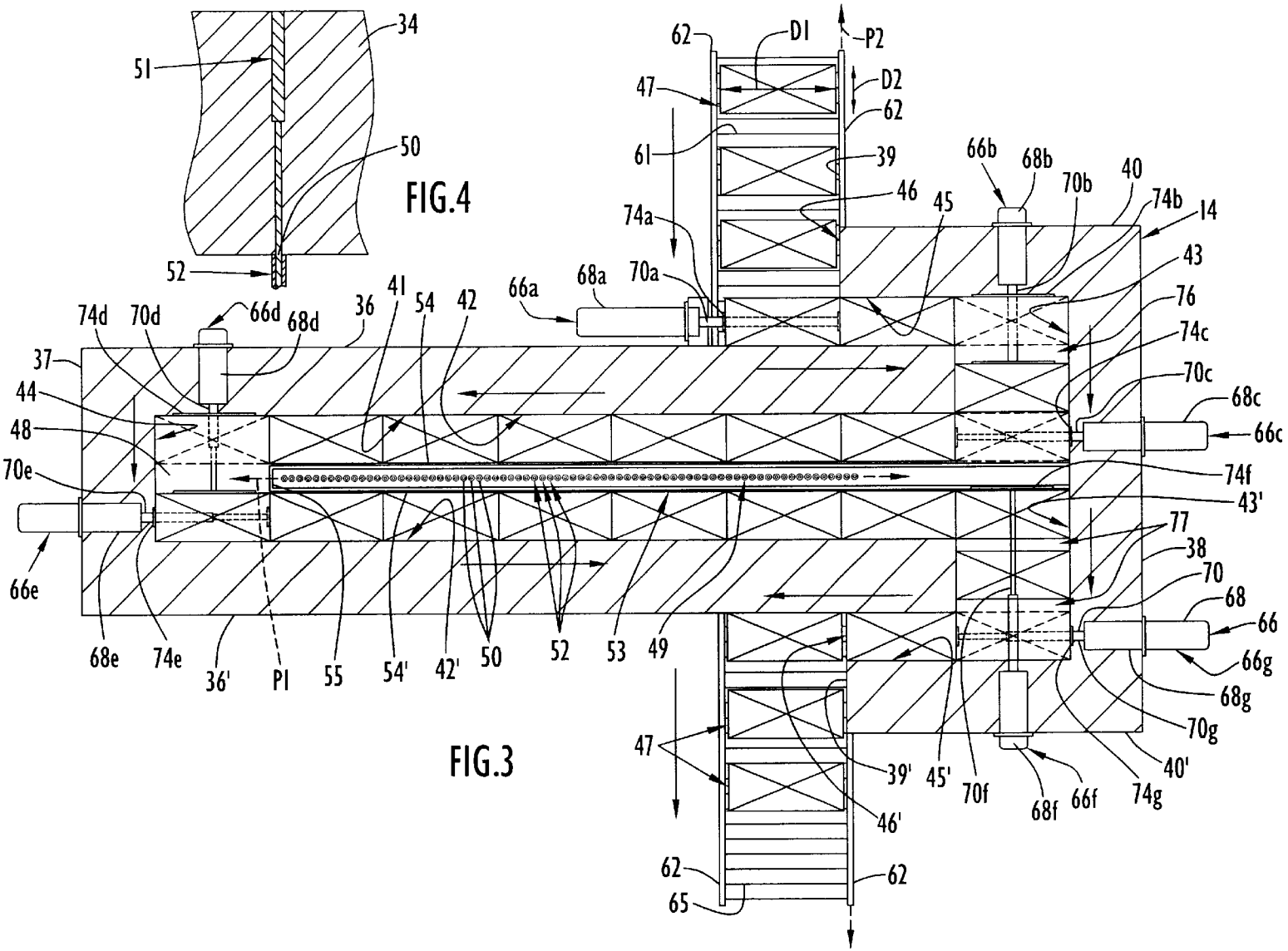
FIG. 3 is a sectional view of the irradiator shell.
FIG. 4 is a broken perspective view of a rod assembly of an irradiation source within the irradiator shell.

As best shown in FIG. 3, a product transport passage or channel 41 is defined within the irradiator shell 14 and is made up of inner longitudinal channel sections 42 and 42', outer transverse channel sections 43 and 43' disposed at first ends of the inner longitudinal channel sections 42 and 42', respectively, an inner transverse channel section 44 disposed at opposite or second ends of the inner longitudinal channel sections 42 and 42', respectively, and outer longitudinal channel sections 45 and 45' disposed at outer ends of the outer transverse channel sections 43 and 43', respectively. The outer longitudinal channel sections 45 and 45' extend from the outer ends of the outer transverse channel sections 43 and 43', respectively, to openings or ports 46 and 46', respectively, in the transverse shell section 32. The openings or ports 46 and 46' are disposed on planar exterior surfaces of side wall segments 39 and 39', respectively, and establish communication with the product transport channel 41 from externally of the shell 14. The openings or ports 46 and 46' are disposed adjacent planar exterior surfaces of the side walls 36 and 36', respectively.

The inner longitudinal channel sections 42 and 42' are parallel to one another and extend longitudinally in the longitudinal shell section 30 and part way into the transverse shell section 32. The outer transverse channel sections 43 and 43', which are disposed within the transverse shell section 32, are perpendicular to the inner longitudinal channel sections 42 and 42' and the outer longitudinal channel sections 45 and 45'. The outer transverse channel sections 43 and 43' have inner ends communicating with the first ends of the inner longitudinal channel sections 42 and 42', respectively, and have the outer ends thereof communicating with the outer longitudinal channel sections 45 and 45', respectively. The inner transverse channel section 44 is perpendicular to the inner longitudinal channel sections 42 and 42'. The inner transverse channel section 44 is disposed in the longitudinal shell section 30 and extends between the opposite or second ends of the inner longitudinal channel sections 42 and 42', respectively. The outer longitudinal channel sections 45 and 45' are disposed in the transverse shell section 32 and are parallel to the inner longitudinal channel sections 42 and 42'. The outer longitudinal channel sections 45 and 45' extend between the outer ends of the outer transverse channel sections 43 and 43', respectively, and the openings or ports 46 and 46', respectively.

The product transport channel 41 and the ports 46 and 46' have a cross-sectional configuration and size large enough to accommodate and facilitate the passage therethrough of products, such as products 47 shown in FIGS. 2 and 3. Preferably, the cross-section of the product transport channel 41 and the ports 46 and 46' corresponds as close as possible in size and configuration to the external cross-section of the individual products 47, or to containers such as bins or baskets holding one or more products, while allowing the products 47 or the containers for the products to freely pass therethrough. The products 47 are moved in a longitudinal direction through the inner and outer longitudinal channel sections 42, 42', 45 and 45' and are moved in a transverse direction, perpendicular to the longitudinal direction, through the inner and outer transverse channel sections 43, 43' and 44. Although the direction of movement for the products 47 through the channel 41 thusly changes, the orientation or position of the products 47 does not change as the products are introduced in, moved through and discharged from channel 41. When the products 47 are moved in channel 41 in the longitudinal direction, an external dimension D1 of the products 47 is aligned with the longitudinal direction of movement. When the products 47 are moved in channel 41 in the transverse direction, an external dimension D2 of the products 47 is aligned with the transverse direction of movement. In the instance of products 47, the external dimension D1 is a major or maximum external dimension defining a major axis of the products while the external dimension D2 is a minor external dimension defining a minor axis of the products.

Where the external dimensions D1 and D2 are equal or the same, the channel 41 may be of uniform or constant cross-section from port 46 to port 46'. Where external dimensions D1 and D2 are not the same, as shown for products 47, the channel 41 can be of non-uniform or non-constant cross-section from port 46 to port 46'. In particular, longitudinal channel sections 42, 42', 45 and 45' can have a cross-section corresponding in size and shape to the cross-section of external dimension D2 while the transverse channel sections 43, 43' and 44 can have a cross-section corresponding in size and shape to the cross-section of external dimension D1. It should be appreciated, therefore, that the cross-section of channel 41 may be uniform and constant or non-uniform and non-constant depending on the cross-sectional dimensions of the products and the direction of movement of the products in the channel 41.

The cross-section of the channel 41 and the ports 46 and 46' is defined or circumscribed by a planar interior surface or surfaces of the wall or walls of the irradiator shell 14, such interior surface or surfaces preferably being made of stainless steel as described above. The planar interior surface 48 of lower wall 35 is a transport surface 48 upon which the products 47 are directly supported and are moved through the irradiator shell 14. The transport surface 48, which is non-moving, may be finished, such as by polishing or other treatment, to minimize friction when the products are moved thereupon. Any or all of the other interior surfaces of the walls of the irradiator shell 14 defining the channel 41 may be finished, such as by polishing or other treatment, to minimize friction and promote passage of the products through the channel 41. The walls of irradiator shell 14 are of sufficient thickness to prevent the emission of unsafe levels of radiation externally of shell 14 from an irradiation source disposed within the shell 14.

An irradiation source 49, shown in FIG. 3, is disposed in shell 14 and includes an array of elongate rods 50 made of radioactive material, such as Cobalt 60. Rods 50 extend vertically in shell 14 with their central longitudinal axes, respectively, disposed in a plane P1 perpendicular to upper and lower walls 34 and 35. A shield plug 51 is provided above the upper end of each rod 50, and each rod 50 is disposed in an outer tube or jacket 52 to form a rod assembly as shown in FIG. 4. Tubes 52 containing rods 50 are disposed close to one another in parallel, side by side relation to be arranged in shell 14 linearly or in series with the central longitudinal axes of rods 50 disposed in the plane P1, which contains the central longitudinal axis of longitudinal shell section 30 and is perpendicular to the transport surface 48 and parallel to the side walls 36 and 36' and the end walls 40 and 40'.

Rods 50, with their outer tubes 52, are disposed in a shell insert 53 disposed between inner longitudinal channel section 42 and inner longitudinal channel section 42'. The shell insert 53 has spaced, planar, parallel side faces 54 and 54' between which the tubes 52 containing rods 50 are disposed, the side faces 54 and 54' being parallel to plane P1. The side faces 54 and 54' extend vertically in the shell 14 between a planar interior surface of the upper wall 34 and the planar interior surface of the lower wall 35, i.e. the transport surface 48. The side faces 54 and 54' extend longitudinally in the shell 14 from a planar interior surface of side wall 38 up to the inner transverse channel section 44, whereat the side faces 54 and 54' are joined to one another by a transverse end face 55. The rods 50 are serially or linearly arranged between the side faces 54 and 54' to extend therebetween a linear distance corresponding or substantially corresponding to the linear distance between the end face 55 and a plane P2 containing planar exterior surfaces of side wall segments 39 and 39' as shown in FIGS. 2 and 3. The linear distance that the rods 50 occupy within the shell 14 defines an active length for the irradiation source 49.

The number of and spacing for the rods in shell 14 may vary depending on the radiation strength or intensity of the individual rods 50, the total or cumulative radiation strength or intensity desired for the source 49 and/or the desired active length. The radiation strength or intensity of the individual rods 50 can vary depending on the number of and spacing for the rods 50, the total radiation strength or intensity desired for the irradiation source and/or the desired active length. The rods 50 have diameters concentrically received within the tubes 52, respectively. The perpendicular distance between side faces 54 and 54' is sufficient to accommodate the tubes 52 therebetween. The rods 50 and tubes 52 have a length extending perpendicularly between the upperwall 34 and the lower wall 35, such length being at least as great as the perpendicular distance between the interior surface of upper wall 34 and the interior surface of lower wall 35, i.e. the transport surface 48. The shield plugs 51 have a stepped configuration for reception in correspondingly configured openings or holes, respectively, in the upper wall 34 as shown in FIGS. 2 and 4. The shield plugs 51 are removably disposed in the upper wall 34 allowing the rods 50 to be removed and/or replaced via withdrawal through the openings or holes in upper wall 34. In particular, the rods 50 can be individually installed and/or removed at the same time that product irradiation is taking place. The irradiation source, i.e. rods 50, is not transported with the enclosure 12 or shell 14. Rather, the enclosure 12 and shell 14 are transported and delivered to the source of the products separately from the irradiation source. It is contemplated that the irradiation source would be purchased from suppliers equipped with licensed transport casks and from whom disposal services would also be obtained.

The shell insert 53 partitions or divides the shell 14 into an inlet or entry side disposed on one side of insert 53 and, therefore, plane P1, and an outlet or exit side disposed on the other or opposite side of insert 53 and, therefore, plane P1. The side wall segment 39 is disposed on the one side of plane P1 while the side wall segment 39' is disposed on the opposite side of plane P1. Accordingly, the port 46 constitutes an inlet or entry port, disposed on the one side of plane P1, while the port 46' constitutes an outlet or exit port, disposed on the opposite side of plane P1, the inlet and outlet ports being disposed in plane P2, which is perpendicular to plane P1. A prescribed path is defined in shell 14 between the inlet port 46 and the outlet port 46' and along which the products 47 are moved through the shell 14. The prescribed path, which corresponds to the transport channel 41, begins at the inlet port 46 and includes, in sequence, the outer longitudinal channel section 45, the outer transverse channel section 43, the inner longitudinal channel section 42, the inner transverse channel section 44, by which the inlet side and the outlet side are in communication, the inner longitudinal channel section 42', the outer transverse channel section 43' and the outer longitudinal channel section 45', the prescribed path terminating at the outlet port 46'. Hence, the transport surface 48 extends from the inlet port to the outlet port, which is spaced or remote from or disposed at a different location than the inlet port. A portion of the prescribed path is in a high radiation zone of the transport channel 41, the high radiation zone corresponding to the active length of the irradiation source 49. Accordingly, the high radiation zone is defined between plane P2 and the inner transverse channel section 44 and thusly includes the inner longitudinal channel sections 42 and 42'.

The shell 14 can be introduced in the interior of enclosure 12 via the access opening presented when the doors 20 forming rearward wall 19 are open. The lower wall 35 of shell 14 is supported upon the bottom wall or floor 16 of enclosure 12. The shell 14 is positioned in the interior of enclosure 12 so that the inlet port 46 and the outlet port 46' are aligned with the entry and exit openings, respectively, of the enclosure, the entry and exit openings being presented when the rearwardmost doors 20 on side walls 17 and 17', respectively, are open. Subsequent to introduction and proper positioning of shell 14 in the interior of enclosure 12, the doors 20 forming rearward wall 19 will normally remain closed and locked. The doors 20 defining the entry and exit openings, respectively, will be open during operation of the product irradiation device 10 and will normally be closed and locked when the product irradiation device 10 is not in operation.

Products 47, prior to being irradiated, are presented at the inlet port 46 via a delivery member 60 extending through the entry opening of enclosure 12 and establishing communication between the inlet port 46 and the source of the products 47. The delivery member 60 may be supplied as part of the product irradiation device 10 or as a separate component provided by the user of the product irradiation device, in which case the product irradiation device may be supplied without a delivery member. In the case of product irradiation device 10, the delivery member 60 is supplied as part of the product irradiation device and includes a roller ramp 61 extending through the entry opening of enclosure 12 and having a first end positioned in front of the inlet port 46, adjacent or in abutment with the planar exterior surface of the side wall 36, and a second end disposed at or proximate the source of the products 47.

The first end of the roller ramp 61 is located directly in front of the inlet port 46 so that a product 47 supported on the first end is aligned with the inlet port 46 and is ready to be passed therethrough into the transport channel 41. The second end of the roller ramp 61 is disposed, externally of enclosure 12, at a convenient location at the source of the products 47. For example, the second end of the roller ramp 61 may be disposed at a loading dock or other location of the manufacturing or processing facility for the products 47. The second end of roller ramp 61 is elevated or disposed higher than the first end thereof so that the products 47 are conveyed by gravity from the second end to the first end. Accordingly, the roller ramp 61 will be disposed at an obtuse angle to the ground or other surface upon which the enclosure 12 is supported. As shown in FIG. 2, the first end of the roller ramp 61 may be angled relative to the remainder thereof so that the first end of the roller ramp 61 is disposed in the same or substantially the same plane as the transport surface 48.

Products 47 positioned upon the second end of the roller ramp 61 are automatically conveyed by gravity from the second end to the first end of the roller ramp 61, as facilitated by rollers of the roller ramp, the products 47 being guided or directed by upstanding, parallel side rails 62 of the roller ramp 61. As shown in FIGS. 2 and 3, the perpendicular distance between side rails 62 corresponds to the external dimension D1 of the products 47. The products 47 are conveyed along the delivery member 60 in a transverse direction perpendicular to plane P1 with the minor axis or external dimension D2 of the products 47 longitudinally or axially aligned with the transverse direction of conveyance of the products along the delivery member and with the major axis or external dimension D1 of the products parallel with plane P1. Accordingly, products are presented at the first end of the delivery member with the major axis longitudinally or axially aligned with inlet port 46 and outer longitudinal channel section 45. The exterior surface of side wall 36 serves as a stop or abutment for the products 47 at the first end of the delivery member 60 and facilitates alignment of the products 47 with the inlet port 46 and with the outer longitudinal channel section 45.

Products 47, subsequent to being irradiated, exit the shell 14 through the outlet port 46' and are discharged onto a discharge member 64 extending through the exit opening of enclosure 12. The discharge member 64 may be supplied as part of the product irradiation device 10 or as a separate component provided by the user, in which case the product irradiation device can be supplied without a discharge member. In the case of product irradiation device 10, the discharge member 64 is supplied as part of the product irradiation device and includes a roller ramp 65, similar to the roller ramp 61. The roller ramp 65 extends through the exit opening of enclosure 12 and has a first end positioned in front of the outlet port 46', adjacent or in abutment with a planar exterior surface of the side wall 36', and a second end disposed at or proximate the source of the products 47.

As shown in FIGS. 2 and 3, the first end of the roller ramp 65 is located directly in front of the outlet port 46' so that a product 47 discharged through the outlet port 46' is delivered onto the first end of the roller ramp 65. The second end of the roller ramp 65 is disposed, externally of enclosure 12, at a convenient location at the source of the products 47. For example, the second end of the roller ramp 65 may be disposed at another loading dock or location of the manufacturing or processing facility for the products 47. The second end of roller ramp 65 is disposed lower than the first end thereof so that the products 47 are conveyed by gravity from the first end to the second thereof. Accordingly, the roller ramp 65 will be disposed at an acute angle to the ground or surface upon which the enclosure 12 is supported. As shown in FIG. 2, the first end of the roller ramp 65 may be angled relative to the remainder thereof so that the first end of the roller ramp 65 is disposed in the same or substantially the same plane as the transport surface 48.

Products 47 discharged through the outlet port 46' onto the first end of roller ramp 65 are automatically conveyed from the first end to the second end thereof as facilitated by rollers of the roller ramp 65, and the products 47 are guided by upstanding, parallel side rails 62 of the roller ramp 65. The products 47 are discharged from the outlet port 46' with their major axis or external dimension D1 parallel to plane P1. The products 47 are conveyed along the discharge member 64 in a transverse direction perpendicular to plane P1 with the minor axis or external dimension D2 of the products 47 longitudinally or axially aligned with the transverse direction of conveyance of the products along the discharge member and with the major axis or external dimension D1 parallel with plane P1.

It should be appreciated that the delivery member, the discharge member, the shell and/or the enclosure may be provided with a mechanism or mechanisms for securing the first ends of the delivery member and the discharge member, respectively, adjacent the inlet port and the outlet port, respectively. It should be further appreciated that the mechanism or mechanisms used to secure the first ends of the delivery member and/or the discharge member, respectively, adjacent the inlet port and outlet port, respectively, can be designed to allow the delivery member and/or discharge member to be detached or released from the shell and/or the enclosure. Accordingly, the delivery member and/or the discharge member can be detached or removed from the enclosure and/or the shell when the product irradiation device is not in use. The delivery member and/or the discharge member can be designed for movement between a deployed position, wherein the delivery member and/or the discharge member extends externally from the enclosure, and a nondeployed position, wherein the delivery member and/or the discharge member is disposed within the enclosure. For example, the delivery member and/or the discharge member may be pivotably, hingedly or rotatably mounted to the enclosure and/or the shell so that the delivery member and/or the discharge member may be pivotably, rotatably or hingedly moved into the enclosure to assume the nondeployed position and may be pivotably, hingedly or rotatably moved out from the enclosure to assume the deployed position. It should also be appreciated that the angular orientations of the delivery member and the discharge member, respectively, including the first ends thereof, can be selected, adjusted or varied in accordance with the conveying speed desired for the products therealong.

A plurality of hydraulic or pneumatic actuators 66 are provided in or on the product irradiation device 10 for moving or advancing the products 47 incrementally into, through and out of the shell 14 in the prescribed path. The actuators 66 serve to push and/or pull the products 47, in fixed increments, into, through and out of the shell 14, and each includes a hydraulic or pneumatic cylinder 68 and a piston 70 slidably disposed in the cylinder 68. Seven actuators 66*a*, 66*b*, 66*c*, 66*d*, 66*e*, 66*f* and 66*g* are provided for product irradiation device 10 as best shown in FIG.3.

The actuator 66*a* serves to push a product 47 disposed at the first end of the delivery member 60 through the inlet port 46 and into the outer longitudinal channel section 45. The actuator 66*a* is disposed externally of shell 14 in its entirety with its cylinder 68*a* and piston 70*a* longitudinally or axially aligned with the inlet port 46 and the outer longitudinal channel section 45. As shown in FIGS. 2 and 3, the cylinder 68*a* is secured to or mounted on the exterior surface of side wall 36 via a mounting block secured to the side wall 36. The piston 70*a*, which has a longitudinal axis parallel with plane P1 and perpendicular to plane P2, is longitudinally, slidably movable within the cylinder 68a in response to variation in fluidic pressure within the cylinder 68*a*. The piston 70*a* is slidably movable relative to cylinder 68*a* between a retracted position wherein a product engaging end 74*a* of the piston 68*a* is disposed adjacent, close to or in abutment with the cylinder 68*a* and an extended position wherein the product engaging end 74*a* is disposed further away from the cylinder 68*a* and, in particular, is adjacent or aligned with the plane P2 and, therefore, with the inlet port 46 as shown in dotted lines in FIG. 3.

In the retracted position for piston 70*a*, the product engaging end 74*a* is spaced from the plane P2, and the distance that the end 74*a* is spaced from plane P2, i.e. the stroke of piston 70*a*, is at least as large as the external dimension D1 of the products 47. A product 47, when disposed at the first end of the delivery member 60, thusly has its external dimension D1 disposed between the inlet port 46 and the product engaging end 74*a* when the piston 70*a* is in the retracted position. In this manner, the major or maximum external dimension D1 will be disposed parallel to plane P1 and perpendicular to plane P2 when the product 47 is disposed at the first end of the delivery member 60 between the inlet port 46 and the product engaging end 74*a*.

The product engaging end 74*a* engages the product 47 disposed at the first end of the delivery member 60 as the piston 70*a* is moved from the retracted position to the extended position. The product engaging end 74*a* engages the product from behind, such that a pushing force is applied to a rearward end 80' of the product in the direction of its major axis. The product engaging end 74*a* can be formed as or provided with structure or a surface having a size and configuration to facilitate application of the pushing force on the product 47 as the piston 70*a* is moved toward the extended position. In the case of piston 70*a*, the product engaging end 74*a* is formed as a plate having a flat or planar surface for contacting or engaging a flat or planar surface of the product 47. When the piston 70*a* is in the extended position, as shown in dotted lines in FIG. 3, the product 47 pushed thereby will have passed through the inlet port 46 and will be disposed in the outer longitudinal channel section 45. When the piston 70*a* is thereafter moved from the extended position to the retracted position, a next subsequent product 47 is automatically presented, due to gravity, at the first end of the delivery member 60 and is ready to be pushed by the piston 70*a* through the inlet port 46 and into the outer longitudinal channel section 45 in response to movement of the piston 70*a* from the retracted position to the extended position.

Movement of the next subsequent product 47 through the inlet port 46 and into the outer longitudinal channel section 45 by the piston 70*a* causes the next subsequent product to engage, in end to end relation, the next preceding product, i.e. the product 47 previously moved into the outer longitudinal channel section 45 by the piston 70*a*. Accordingly, each time the piston 70*a* is moved from the retracted position to the extended position, a product 47 disposed at the first end of the delivery member 60 is moved through the inlet port 46 into the outer longitudinal channel section 45, causing corresponding movement of all preceding products in the outer longitudinal channel section 45 due to end to end contact or abutment between the products. In this manner, the product at the first end of the delivery member and preceding products in the outer longitudinal channel section 45 are each moved or advanced a single position or increment corresponding to external dimension D1. The products 47 moved by actuator 66*a* are moved in a longitudinal direction parallel to plane P1 with the major axis or external dimension D1 disposed parallel to plane P1 and in longitudinal or axial alignment with the longitudinal direction of movement. Each time the piston 70*a* is moved from the extended position to the retracted position, another product is presented at the first end of the delivery member 60 in alignment with the actuator 66*a* and the inlet port 46.

In the case of product irradiation device 10, the outer longitudinal channel section 45 has a length, parallel to plane P1, corresponding to external dimension D1. Accordingly, only one product 47 can be disposed entirely within the outer longitudinal channel section 45 at a time. A product 47 disposed entirely in the outer longitudinal channel section 45 will be pushed, moved or advanced by a next subsequent product, acted upon by the piston 70*a*, into the outer end of the outer transverse channel section 43, which is aligned and continuous with the outer longitudinal channel section 45. As shown in dotted lines in FIG. 3, a product moved into the outer end of the outer transverse channel section 43 is in end to end contact or abutment with the next subsequent product disposed in the outer longitudinal channel section 45. It should be appreciated that the length of the outer longitudinal channel section can be increased to accommodate more than one product.

The actuator 66*b* serves to push a product located at the outer end of the outer transverse channel section 43 such that the product and all preceding products disposed in the outer transverse channel section 43 is/are advanced or moved a single position or increment. The actuator 66*b* is similar to actuator 66*a* and has its cylinder 68b and piston 70*b* longitudinally or axially aligned with the outer transverse channel section 43. As shown in FIG. 3, the cylinder 68*b* is secured within, on or to the end wall 40 externally of channel 41, with a longitudinal axis of piston 70*b* perpendicular to plane P1 and parallel to plane P2. When the piston 70*b* of actuator 66*b* is in the retracted position, the product engaging end 74*b* thereof is aligned or flush with or is disposed within a recess of the interior surface of end wall 40. Accordingly, a product 47 is capable of being moved, in response to actuation of actuator 66*a,* from the outer longitudinal channel section 45 into the outer end of the outer transverse channel section 43 as described above. The thusly moved product 47 will have its major axis or external dimension D1 longitudinally aligned with the outer longitudinal channel section 45 and will also have its minor axis or external dimension D2 longitudinally or axially aligned with the outer transverse channel section 43.

When the piston 70*b* is thereafter moved from the retracted position to the extended position, the product disposed at the outer end of the outer transverse channel section 43 is engaged, from behind, by the product engaging end 74*b,* such that a pushing force is applied to an outer side 78 of the product in the direction of its minor axis. The product 47 disposed at the outer end of the outer transverse channel section 43 is thusly pushed, moved or advanced one position or increment, the product being moved in a transverse direction perpendicular to plane P1 while its major axis or external dimension D1 remains parallel to plane P1. When the piston 70*b* is thereafter moved from the extended position to the retracted position, a next subsequent product 47 is able to be moved into the outer end of the outer transverse channel section 43 in response to actuation of actuator 66*a*. When the piston 70*b* is moved to the extended position after a subsequent product 47 has been moved into the outer end of the outer transverse channel section 43, the piston 70*b* moves the subsequent product 47, which engages the outer side 78 of the next preceding product 47, in the transverse direction. Accordingly, the product at the outer end of the outer transverse channel section 43 as well as preceding products in the outer transverse channel section 43 are each advanced a single position or increment.

In the case of product irradiation device 10, the outer transverse channel section 43 has a length, between the planar interior surface of end wall 40 and the side face 54, slightly greater than three times the external dimension D2. Accordingly, there is a gap or space 76 between a product at the outer end of the outer transverse channel section 43 and a next preceding product within the outer transverse channel section 43. The distance that the product engaging end 74*b* is extended perpendicularly beyond the interior surface of end wall 40 when the piston 70*b* is in the extended position defines the stroke for piston 70*b* and corresponds to the external dimension D2 plus the width of the gap or space 76. In this manner, a product at the outer end of outer transverse channel section 43 is advanced by piston 70*b* a single position or increment corresponding to the external dimension D2 plus the width of gap 76 while the next preceding product within the outer transverse channel section 43 is advanced, due to side to side contact or abutment between the products, a single position or increment corresponding to the external dimension D2. Subsequent to being so advanced, the next preceding product is disposed at an inner end of the outer transverse channel section 43, as shown in dotted lines in FIG. 3, with its major axis or external dimension D1 longitudinally or axially aligned with the inner longitudinal channel section 42, the inner end of the outer transverse channel section 43 being longitudinally aligned and continuous with the inner longitudinal channel section 42. The products 47 are moved, via actuation of actuator 66*b,* in the transverse direction perpendicular to plane P1 with the minor axis or external dimension D2 longitudinally or axially aligned with the transverse direction of movement.

The actuator 66*c* serves to push a product 47 at the inner end of the outer transverse channel section 43 into the inner longitudinal channel section 42. The actuator 66*c* is similar to actuators 66*a* and 66*b* and has its cylinder 68*c* and piston 70*c* longitudinally or axially aligned with the inner longitudinal channel section 42. The cylinder 68*c* is secured within, on or to the side wall 38 externally of channel 41 with a longitudinal axis of piston 70*c* parallel to plane P1. When the piston 70*c* is in the retracted position, the product engaging end 74*c* thereof is aligned or flush with or disposed within a recess in the interior surface of side wall 38 such that a product 47 is capable of being moved, in response to actuation of actuator 66*b,* into the inner end of outer transverse channel section 43 as described above.

When the piston 70*c* is thereafter moved from the retracted position to the extended position, the product 47 disposed at the inner end of the outer transverse channel section 43 is engaged, from behind, by the product engaging end 74*c,* which applies a pushing force against a forward end 80 of the product in the direction of its major axis, and is moved in a longitudinal direction parallel to plane P1 into the inner longitudinal channel section 42 as shown in dotted lines in FIG. 3. The product 47 at the inner end of the transverse channel section 42 is thusly moved or advanced a single position or increment while its major axis or external dimension D1 remains parallel to plane P1. Thereafter, when the piston 70*c* is moved from the extended position to the retracted position, a next subsequent product 47 is able to be moved into the inner end of the outer transverse channel section 43. When the piston 70*c* is moved from the retracted position to the extended position after a subsequent product 47 has been moved into the inner end of the outer transverse channel section 43, the subsequent product as well as preceding products in the inner longitudinal channel section 42 are each advanced, due to end to end contact or abutment of the products, a single position or increment corresponding to the external dimension D1. When a sufficient number of products 47 are disposed in the inner longitudinal channel section 42, operation of actuator 66*c* causes a most preceding product 47 in the inner longitudinal channel section 42 to be moved into an outer end of the inner transverse channel section 44 as shown in dotted lines in FIG. 3, the outer end of the inner transverse channel section 44 being longitudinally aligned and continuous with the inner, longitudinal channel section 42.

The products 47 are moved, via actuation of actuator 66*c,* in the longitudinal direction with the major axis or external dimension D 1 thereof longitudinally or axially aligned with the longitudinal direction of movement. Since the pushing force of piston 70*c* is applied to forward ends 80 of the products while the pushing force of piston 70*a* is applied to rearward ends 80' of the products, the longitudinal direction of movement for products advanced by actuator 66*a* is opposite the longitudinal direction of movement for products advanced by actuator 66*c*.

In the case of product irradiation device 10, the distance that product engaging end 74*c* is extended perpendicularly beyond the interior surface of side wall 38 when the piston 70*c* is in the extended position defines the stroke for piston 70*c* and corresponds to the external dimension D1. Accordingly, when piston 70*c* moves a product at the inner end of outer transverse channel section 43, the product and all preceding products disposed in the inner longitudinal channel section 42 are each advanced a single position or increment corresponding to the external dimension D1. The inner longitudinal channel section 42 has a length between the inner end of outer transverse channel section 43 and the outer end of inner transverse channel section 44 corresponding to the combined external dimensions D1 of six products 47. Therefore, six products 47 are disposed in the inner longitudinal channel section 42 during normal operation of the product irradiation device 10 with such products in contact or abutment with one another in end to end relation. In addition, the most preceding product in inner longitudinal channel section 42 contacts or abuts the product, shown in dotted lines in FIG. 3, at the outer end of the inner transverse channel section 44 in end to end relation, and the most subsequent product in the inner longitudinal channel section 42 contacts or abuts the product, shown in dotted lines in FIG. 3, at the inner end of the outer transverse channel section 43 in end to end relation. Of course, the length of inner longitudinal channel section 42 can be increased or decreased to accommodate more or fewer products therein.

The actuator 66*d* serves to push a product at the outer end of the inner transverse channel section 44 so as to advance the product in the inner transverse channel section 44 a single position or increment. The actuator 66*d* is similar to actuators 66*a,* 66*b* and 66*c*. Actuator 66*d* has its cylinder 68*d* and piston 70*d* longitudinally or axially aligned with the inner transverse channel section 43. The cylinder 68*d* is secured within, on or to the side wall 36, externally of channel 41, with a longitudinal axis of piston 70*d* perpendicular to plane P1. When the piston 70*d* is in the retracted position, the product engaging end 74*d* thereof is aligned or flush with or is disposed within a recess in the interior surface of side wall 36. Accordingly, a product 47 is capable of being moved, in response to actuation of actuator 66*c,* from the inner longitudinal channel section 42 into the outer end of the inner transverse channel section 44 as described above. The thusly moved product will have its major axis or external dimension longitudinally or axially aligned with the inner longitudinal channel section 42 and will have its minor axis or external dimension D2 longitudinally or axially aligned with the inner transverse channel section 44, with its major axis or external dimension D1 remaining parallel to plane P1.

When the piston 70*d* is thereafter moved from the retracted position to the extended position, the product 47 disposed at the outer end of inner transverse channel section 44 is engaged, from behind, by product engaging end 74*d* such that a pushing force is applied to the outer side 78 of the product in the direction of its minor axis. The product disposed at the outer end of inner transverse channel section 44 is thusly moved or advanced a single position or increment in the transverse direction perpendicular to plane P1. When the piston 70*d* is moved back to the retracted position, a next subsequent product 47 is able to be moved from the inner longitudinal channel section 42 into the outer end of transverse channel section 44 in response to actuation of actuator 66*c*. When the piston 70*d* is moved to the extended position after a subsequent product has been moved into the outer end of the inner transverse channel section 44, the subsequent product is advanced in the inner transverse channel section 44. Products 47 are moved, via actuation of actuator 66*d,* in the transverse direction perpendicular to plane P1 with the minor axis or external dimension D2 longitudinally or axially aligned with the transverse direction of movement and the major axis or external dimension D1 parallel to plane P1. The transverse direction of movement for products advanced by actuator 66*d* is in the same direction as the transverse direction of movement for products advanced by actuator 66*b*.

In the case of product irradiation device 10, the inner transverse channel section 44 has a length defined between interior surfaces of side walls 36 and 36', respectively, and the length of inner transverse channel section 44 is greater than the combined external dimensions D2 of two products 47. Accordingly, the distance that the product engaging end 74*d* of piston 70*d* is extended perpendicularly beyond the interior surface of side wall 36, when the piston 70*d* is in the extended position, defines the stroke of piston 70*d* and is greater than the external dimension D2. In particular, the stroke of piston 70*d* is equal to the length of the inner transverse channel section 44 minus the external dimension D2. In this manner, a product 47 is moved by piston 70*d* from the outer end of inner transverse channel section 44 to the opposite, outer end of inner transverse channel section 44 in a single stroke, the opposite, outer end of the inner transverse channel section 44 being longitudinally aligned and continuous with the inner longitudinal channel section 42'. Accordingly, the product 47 moved by piston 70*d* does not advance any preceding products in the inner transverse channel section 44 since no preceding products can be accommodated in inner transverse channel section 44. Since the product moved by piston 70*d,* in a single stroke, is moved from the outer end of the inner transverse channel section 44 to the opposite, outer end of the inner transverse channel section 44, such product is moved from the inlet side to the outlet side of the shell 14.

The actuator 66*e* serves to push the product 47 disposed at the opposite, outer end of the inner transverse channel section 44 into the inner longitudinal channel section 42' such that it and preceding products disposed in the inner longitudinal channel section 42' is/are advanced a single position. The actuator 66*e* is similar to actuators 66*a,* 66*b,* 66*c* and 66*d* and has its cylinder 68*e* and piston 70*e* longitudinally or axially aligned with the inner longitudinal channel section 42'. The cylinder 68*e* is secured in, on or to the end wall 37, externally of channel 41, with a longitudinal axis of piston 70*e* parallel to plane P1. When the piston 70*e* is in the retracted position, the product engaging end 74e thereof is aligned or flush with or disposed within a recess in the interior surface of end wall 37 such that a product 47 is capable of being moved, in response to actuation of actuator 66*d,* from the outer end of inner transverse channel section 44 to the opposite, outer end of the inner transverse channel section 44 as described above. The thusly moved product 47 will have its major axis or external dimension D1 longitudinally or axially aligned with the inner longitudinal channel section 42' and, therefore, parallel to plane P1.

When the piston 70*e* is thereafter moved from the retracted position to the extended position, the product 47 disposed at the opposite, outer end of inner transverse channel section 44 is engaged, from behind, by the product engaging end 74*e,* which applies a pushing force against the rearward end 80' of the product in the direction of its major axis. As shown in dotted lines in FIG. 3, the product disposed at the outer end of inner transverse channel section 44 is moved in the longitudinal direction, parallel to plane P1, into the inner longitudinal channel section 42' and is advanced a single position or increment while its major axis or external dimension D1 remains parallel to plane P1. Thereafter, when the piston 70*e* is moved back to the retracted position, a subsequent product 47 is able to be moved into the opposite, outer end of the inner transverse channel section 44 via actuator 66*d*. When the piston 70*e* is moved from the retracted position to the extended position after a subsequent product has been moved into the opposite, outer end of inner transverse channel section 44, the subsequent product as well as preceding products in the inner longitudinal channel section 42' are each advanced a single position or increment, corresponding to the external dimension D 1, due to end to end abutment or contact between the products in the inner longitudinal channel section 42'.

When a sufficient number of products are disposed in the inner longitudinal channel section 42', operation of actuator 66*e* causes a most preceding product in the inner longitudinal channel section 42' to be moved into an inner end of the outer transverse channel section 43', the inner end of the outer transverse channel section 43' being longitudinally aligned and continuous with the inner longitudinal channel section 42'. Products 47 are moved, via actuation of actuator 66*e,* in the longitudinal direction with the major axis or external dimension D1 longitudinally or axially aligned with the longitudinal direction of movement. The longitudinal direction of movement for products advanced by actuator 66*e* is in the same direction as the longitudinal direction of movement for products advanced by actuator 66*a,* which is opposite the longitudinal direction of movement for products advanced by actuator 66*c*.

In the case of product irradiation device 10, the distance that the product engaging end 74*e* is disposed beyond the interior surface of end wall 37 when the piston 70*e* is in the extended position defines the stroke for piston 70*e* and is equal to external dimension D1. The length of inner longitudinal channel section 42' is the same as the length of inner longitudinal channel section 42 such that six products 47 are accommodated in the inner longitudinal channel section 42' in end to end contact or abutment. The most subsequent product in the inner longitudinal channel section 42' is in end to end contact or abutment with the product at the opposite, outer end of inner transverse channel section 44 as shown in dotted lines in FIG. 3. The most preceding product in the inner longitudinal channel section 42' is in end to end contact or abutment with the product at the inner end of the outer transverse channel section 43'. Of course, the length of the inner longitudinal channel section 42' can be modified in order to accommodate a greater or fewer number of products therein, and the length of the inner longitudinal channel section 42' does not have to be the same as the length of inner longitudinal channel section 42 so that different numbers of products can be accommodated therein.

The actuator 66*f* serves to pull a product 47 at the inner end of outer transverse channel section 43' to advance the product a single position or increment in the outer transverse channel section 43'. The actuator 66*f* has a cylinder 68f mounted in, on or to the end wall 40', externally of channel 41, and a piston 70*f* slidably disposed in the cylinder 68*f* for movement between extended and retracted positions in response to variation in fluidic pressure in the cylinder 68*f*. The cylinder 68*f* and piston 70*f* are aligned with the outer transverse channel section 43' with a longitudinal axis of piston 70*f* perpendicular to plane P1 such that the piston 70*f* is slidable within a space between an upper side of the product or products 47 in outer transverse channel section 43' and the top wall 34 of shell 14 or within a recess formed in the top wall 34 of shell 14. The piston 70*f* has a product engaging end 74*f* depending therefrom and disposed in abutment with the side face 54' or within a recess of side face 54' in the extended position so as not to block or obstruct movement of a product, in response to actuation of actuator 66*e,* from the inner longitudinal channel section 42' into the inner end of the outer transverse channel section 43'. The product engaging end 74*f* is formed as a flat plate or is otherwise configured to engage the product disposed at the inner end of outer transverse channel section 43'.

In the extended position for piston 70*f,* the product engaging end 74*f* is in a position to engage the outer side 78 of the product at the inner end of the outer transverse channel section 43', and such product will be disposed between the end 74*f* and the interior surface of end wall 40'. The product engaging end 74*f* engages the outer side 78 of the product at the inner end of outer transverse channel section 43' such that a pushing force is applied to the outer side 78 of the product in the direction of its minor axis when the piston 70*f* is moved to the retracted position. The product at the inner end of outer transverse channel section 43' is moved by piston 70*f* in a transverse direction, perpendicular to plane P1, toward the outer end of the outer transverse channel section 43'. As the product at the inner end of outer transverse channel section 43' is moved by piston 70*f,* a preceding product or products 47 in outer transverse channel section 43' is/are moved or advanced in the outer transverse channel section 43' due to side to side contact or abutment between the products. The products 47 are moved, in response to actuation of actuator 66*f,* in the transverse direction with the minor axis or external dimension D2 longitudinally or axially aligned with the transverse direction of movement and with the major axis or external dimension D1 parallel to plane P1. The transverse direction of movement for the products advanced by actuator 66*f* is in the same direction as the transverse direction of movement for products advanced by actuators 66*b* and 66*d*.

In the case of product irradiation device 10, the outer transverse channel section 43' has a length between side face 54' and the interior surface of end wall 40', and the length of the outer transverse channel section 43' is the same or substantially the same as the length of outer transverse channel section 43. When the product 47 at the inner end of outer transverse channel section 43' is pulled by piston 70*f,* a single next preceding product is moved, in response thereto, into the outer end of the outer transverse channel section 44' as shown in dotted lines in FIG. 3, the outer end of the outer transverse channel section 43' being longitudinally aligned and continuous with the outer longitudinal channel section 42'. There is a gap or space 77 between the product 47 disposed at the inner end of the transverse channel section 43' and the next preceding product in the outer transverse channel section 43'. Depending on the design of actuator 66*f,* the stroke of piston 70*f,* i.e. the distance that the piston 70*f* moves between the extended and retracted positions, may correspond or substantially correspond to the external dimension D2 plus the width of the gap or space 77, which is the case for actuator 66*f*. Accordingly, in the retracted position, the product engaging end 74*f* will have moved from the extended position a distance equivalent or substantially equivalent to the dimension D2 plus the width of gap 77. It should be appreciated that the piston 70*f* does not have to extend into the outer transverse channel section 43' in the extended position or in the retracted position such as, for example, when the piston 70*f* is slidably disposed in a passageway or recess formed in the interior surface of upper wall 34 with only the end 74*f* protruding into the outer transverse channel section 43'.

When the piston 70*f* is moved from the extended position to the retracted position, the product at the inner end of the outer transverse channel section 43' is pulled thereby. The next preceding product in the outer transverse channel section has its outer side 78 spaced, by the width of gap 77, from the inner side 78' of the product disposed at the inner end of the outer transverse channel section 43'. As the product at the inner end of the outer transverse channel section 43' is pulled by piston 70*f*, the inner side 78' thereof engages the outer side 78 of the next preceding product such that the next preceding product is advanced therewith. Accordingly, products in outer transverse channel section 43' are moved or advanced by actuator 66*f* a single position or increment corresponding or substantially corresponding to the external dimension D2 plus the width of gap 77. The next preceding product is thusly moved into the outer end of the outer transverse channel section 43' as shown in dotted lines in FIG. 3, and the product pulled by end 74*f* becomes a next preceding product for the next product to be moved from the inner longitudinal channel section 42' into the inner end of the outer transverse channel section 43' following return of piston 70*f* to the extended position. It should be appreciated that, depending on the length of the outer transverse channel section 43', no gap need be present between the products therein, in which case the stroke of piston 70*f* can be equivalent to the dimension D2 so that the product or products is/are pulled or moved by piston 7Of an increment equivalent to one product width.

Actuator 66*g* serves to push a product 47 at the outer end of the outer transverse channel section 43' into the outer longitudinal channel section 45'. The actuator 66*g* is similar to actuators 66*a*, 66*b*, 66*c*, 66*d* and 66*e* and includes cylinder 68*g* mounted within, on or to the side wall 38, externally of channel 41, with its piston 70*g* longitudinally or axially aligned with the outer longitudinal channel section 45'. The longitudinal axis of piston 70*g* is parallel to plane P1; and, when the piston 70*g* is in the retracted position, the product engaging end 74*g* thereof is aligned or flush with or is disposed within a recess in the interior surface of side wall 38. Accordingly, a product 47 is capable of being moved into the outer end of outer transverse channel section 43' in response to actuation of actuator 66*f* as described above. The thusly moved product 47 will have its major axis or external dimension D1 longitudinally or axially aligned with the outer longitudinal channel section 45' and will have its minor axis or external dimension D2 longitudinally or axially aligned with the outer transverse channel section 43', the outer transverse channel section 43' being longitudinally aligned and continuous with the outer longitudinal channel section 45'.

When the piston 70*g* is thereafter moved from the retracted position to the extended position, the product 47 disposed at the outer end of the outer transverse channel section 43' is engaged, from behind, by product engaging end 74*g* such that a pushing force is applied to the forward end 80 of the product in the direction of its major axis. The product disposed at the outer transverse channel section 43' is thusly moved or advanced a single position or increment in the longitudinal direction parallel to plane P1 as shown in FIG. 3. Accordingly, the product disposed at the outer end of the outer transverse channel section 43' is moved into the outer longitudinal channel section 45' causing products 47 in the outer longitudinal channel 45' to be correspondingly moved or advanced a single position or increment. The products 47 moved by actuator 66*g* are moved in the longitudinal direction, parallel to plane P1, with the major axis or external dimension D1 longitudinally or axially aligned with the longitudinal direction of movement. The longitudinal direction of movement for products advanced by actuator 66*g* is in the same direction as the longitudinal direction of movement for products 47 advanced by actuator 66*c*. The major axis or external dimension D1 of the products moved by actuator 66*g* remains parallel to plane P1. When the piston 70*g* is moved back to the retracted position, a next subsequent product 47 is able to be moved into the outer end of the outer transverse channel section 43' in response to actuation of actuator 66*f*. When the piston 70*g* is moved to the extended position after a subsequent product has been moved into the outer end of the outer transverse channel section 43', the subsequent product and preceding products are advanced a single position due to end to end contact or abutment between the products.

In the case of product irradiation device 10, the outer longitudinal channel section 45' has a length that is the same as the length of the outer longitudinal channel section 45, and the stroke for piston 70*g* is the same as that for piston 70*a*. When a product at the outer end of the outer transverse channel section 43' is pushed by actuator 66*g*, a single next preceding product in outer longitudinal channel section 45' is thereby pushed through the outlet port 46' and is discharged onto the first end of the discharge member 64. The product 47 that is discharged onto the first end of the discharge member 64 is automatically conveyed, by gravity, toward the second end of the discharge member allowing a next subsequent product 47 to be discharged onto the first end thereof the next time that piston 70*g* is moved to the extended position. Products 47 are conveyed along the discharge member 64 in a transverse direction perpendicular to plane P1 while the major axis or external dimension D1 of the products remains parallel to plane P1. The transverse direction of movement for products 47 along the discharge member 64 is in the same direction as the transverse direction of movement for products 47 along the delivery member 60 and within the outer transverse channel sections 43 and 43' and the inner transverse channel section 44.

The fluid used to operate the actuators may comprise a liquid or a gas, such as compressed air. A fluid supply system (not shown) including a fluid source, conduits for supplying fluid to the cylinders from the fluid source and valves for controlling the pressure of fluid in the cylinders is disposed externally of the shell 14 and, preferably, is disposed within the interior of enclosure 12. A control system (not shown) for effecting automatic, timed extension and retraction of the pistons, individually or in selective unison, is also disposed externally of shell 14 and, preferably, within the interior of enclosure 12. In particular, the control system is adapted, via an appropriate software program, to effect automatic, simultaneous extension and retraction of pistons 70*a*, 70*c*, 70*e* and 70*g* in alternating sequence with simultaneous extension and retraction of pistons 70b, 70*d* and 70*f*. The control system preferably includes computer software and a control panel by which extension and retraction of particular pistons can be selected and by which the timing for extension and retraction of the pistons can be selected and adjusted as desired to control the speed with which the products 47 are moved through the transport channel 41. The excess space in enclosure 12 may be used to store additional rods 50 as well as machinery for removing and inserting the rods 50 in transport containers and for removing and replacing rods 50 within the shell 14. In particular, the enclosure 12 will have a storage container therein, capable of storing the rods 50 after receipt from the supplier. The delivery and discharge members 60 and 64 may also be stored in the interior of enclosure 12 when the product irradiation device 10 is not in use.

Preferably, the control system is adapted to provide verification of piston movement and, therefore, proper operation or actuation of the actuators. The control system can include an indicator, such as an alarm, to provide an indication of malfunction of the actuators. For example, the indicator can be responsive to failure of one or more of the pistons to properly extend and/or retract. The control system can also be adapted to identify the location or locations of a malfunction or malfunctions, such as identification of a particular piston or pistons that does/do not properly extend and/or retract.

According to a preferred embodiment of the product irradiation device 10, the enclosure 12 has an interior length of approximately 52.5 feet, an interior width of approximately 99 inches and an interior height of approximately 110 inches. The shell 14 has an overall length, between exterior surfaces of end wall 37 and side wall 38, of approximately 5 feet, 4¼ inches, a major width, between exterior surfaces of end walls 40 and 40', of approximately 7 feet, 4½ inches, a minor width, between exterior surfaces of side walls 36 and 36', of approximately 3 feet, 10½ inches and a height, between exterior surfaces of upper and lower walls 34 and 35, of approximately 45 inches. The active length for irradiation source 49 is approximately 8 feet, 3 inches. An interior width of shell 14, between interior surfaces of side walls 36 and 36' is approximately 22½ inches. Rods 50 may be conventional, such as the Cobalt 60 rods supplied by MDS Nordian of Canada and Reviss/Puridec of the United Kingdom. Typical rods have a diameter of 0.380 inch and an active length of 16.0 inches. In the preferred embodiment, each rod 50 has a radiation strength or intensity of 10,000 curies, and one hundred twenty rods 50 are linearly arranged in the shell insert. The tubes 51 are preferably made of stainless steel and have an outer diameter of 0.5 inch. The faces of shell insert 53 are made of stainless steel, and the shell insert has an inner width, defined between interior surfaces of side faces 54 and 54' of 0.5 inch. The shield plugs 55 are preferably made of stainless steel. It should be appreciated that the specific dimensions of the enclosure, the shell, the irradiation source, the tubes and the shell insert can vary and that the specific dimensions described herein for a preferred embodiment should be considered exemplary. Similarly, the various dimensions of the transport channel can vary, and greater or fewer numbers of products can be accommodated in the various transport channel sections than those illustrated herein by way of example. Furthermore, corresponding sections of the transport channel do not have to accommodate the same number of products.

The products 47 are illustrated in FIGS. 2 and 3 as boxed products, each comprising a box made of a radiation penetrable material and a product, object, substance or material, such as food, to be irradiated disposed within the box. As an example, each product 47 may comprise a plurality of preformed hamburgers enclosed in a sealed box. The boxes of products 47 have a rectangular configuration including a pair of planar, parallel, outer and inner sides 78 and 78', respectively, a pair of planar, parallel, upper and lower sides 79 and 79', respectively, and a pair of planar, parallel, forward and rearward ends 80 and 80', respectively, connecting sides 78, 78', 79 and 79' as shown in FIG. 2. However, it should be appreciated that the product irradiation device 10 can be used to irradiate various types of naturally and artificially produced or created products including boxed products and non-boxed products as well as products having different sizes and configurations. As a further example, the products to be irradiated may comprise flowers or other plant material, the irradiation of which results in relatively longer shelf/vase life and increased freshness. In the case of products 47, the boxes thereof are irradiated in order to enhance the quality of the products, substances or materials disposed within the boxes. However, it should be appreciated that products, substances or materials to be irradiated can be irradiated using the product irradiation device 10 without being disposed or enclosed in boxes or other containers.

FIG. 5 illustrates a modification of products to be irradiated in accordance with the present invention. FIG. 5 illustrates a basket 147 containing a plurality of smaller, individual packages or objects 157 to be irradiated. A plurality of baskets 147 can be supplied for use with the product irradiation device, and the packages or objects 157 are placed in the baskets 147 prior to passage of the baskets 147 through the product irradiation device. Each basket has a bottom 181 to be disposed upon and in contact with the transport surface when the baskets 147 are moved through the transport channel. The baskets 147 are continuously moved into, through and out of the product irradiation device in the same manner as described herein for boxes 47. The objects 157 can be of variable sizes or can be the same size. In FIG. 5, the objects 157 are shown as packages of different, variable sizes.

As shown in dotted lines in FIG. 2, the products 47 can be provided with a radiation monitoring or indicating device 82. The radiation monitoring or indicating device 82 is disposed on an outer surface of the box of a product 47, such as being disposed on the outer surface of inner side 78'. The radiation monitoring or indicating device 82 is capable of providing a visual indication, for example a color change, of exposure of product 47 to the proper dose of radiation.

In the case of products 47, the products, substances or materials to be irradiated are normally placed and sealed in the boxes as part of their manufacturing or processing procedures. Accordingly, the products 47 may be irradiated subsequent to manufacture or processing without any additional handling, exposure to the environment or other interference with the products, materials or substances disposed inside the boxes. The length of sides 78, 78', 79 and 79' between ends 80 and 80' corresponds to the external dimension D1 of the products 47. The distance between outer and inner sides 78 and 78' corresponds to the external dimension D2 of the products 47. The external dimensions D1 and D2 correspond to the length and width, respectively, of products 47. The distance between upper and lower sides 79 and 79' corresponds to the height of products 47, which is smaller than D1 but larger than D2.

In a method of irradiating products, such as products 47, according to the present invention, the pair of doors 20 defining the entry and discharge openings, respectively, of enclosure 12 are opened. The delivery member 60 is positioned to extend through the entry opening with the first end of the delivery member positioned directly in front of the inlet port 46 and the second end of the delivery member positioned at a location at or proximate the source, such as a manufacturing or processing facility, of the products 47. Similarly, the discharge member 64 is positioned to extend through the discharge opening with the first end of the discharge member positioned directly in front of the outlet port 46 ' and the second end of the discharge member positioned at a different location at or proximate the source. The products 47 are supplied sequentially to the second end of the delivery member 60 manually or mechanically via suitable machinery. Each product 47 is positioned on the delivery member with one of its lower sides 79' disposed upon and in contact with the rollers of the delivery member 60. The products 47 are automatically conveyed or moved, due to gravity, in sequence along the delivery member 60 such that the most preceding product 47 on the delivery member 60 arrives at the first end thereof, the products being guided along the delivery member by the side rails 62. The products 47 are positioned on and conveyed along the delivery member 60 with the major axis or external dimension D1 parallel to plane P1. The products 47 are moved along the delivery member 60 in the transverse direction perpendicular to plane P1, and the exterior surface of the side wall 36 serves as a stop or abutment for a product when it arrives at the first end of the delivery member, whereby a product disposed at the first end of the delivery member 60 is longitudinally or axially aligned with the inlet port 46 and the outer longitudinal channel section 45. When operation of the product irradiation device 10 is initially commenced or started up, the most preceding product 47 on the delivery member will be a lead product.

The actuator 66*a* is operated as described above, individually or simultaneously with actuators 66*c*, 66*e* and 66*g*, to push the product 47 disposed at the first end of the delivery member 60 through the inlet port 46 into the outer longitudinal channel section 45 such that the product is advanced a single increment or position. Where the product 47 at the first end of the delivery member 60 is the lead product, as during initial start up, no preceding products 47 are disposed in channel 41 to be moved by the lead product or by the actuators 66*c*, 66*e* and 66*g*. It should be appreciated, therefore, that actuator 66*a* can be actuated individually during start up without actuation of actuators 66*c*, 66*e* and 66*g*. When the actuators 66*b*, 66*d* and 66*f* are actuated subsequent to actuation of actuators 66*a*, 66*c*, 66*e* and 66*g*, i.e, following retraction of pistons 70*a*, 70*c*, 70*e* and 70*g*, no preceding products are disposed in channel 41 to be moved or advanced thereby where the product previously moved into the channel 41 through the inlet port 46 is the lead product. It should be appreciated, therefore, that the actuator 66*a* can be actuated individually or simultaneously with actuators 66*c*, 66*e* and 66*g* in sequential repetition during initial start up, without actuation of actuators 66*b*, 66*d* and 66*f*, until the lead product has arrived at the outer end of outer transverse channel section 43. Once the lead product 47 has been pushed through the inlet port 46 into the outer longitudinal channel section 45, the next successive or subsequent product 47 arrives at the first end of the delivery member 60 and is longitudinally or axially aligned with the inlet port 46. When the actuator 66*a* is thereafter actuated, individually or simultaneously with actuators 66*c*, 66*e* and 66*g*, the next subsequent product 47 now disposed on the first end of the delivery member 60 is pushed through the inlet port 46 into the outer longitudinal channel section 45, correspondingly moving the next preceding product, i.e. the lead product 47, into the outer end of the outer transverse channel section 43. Accordingly, each time a product 47 is pushed by piston 70*a* through the inlet port 46 from the first end of the delivery member, the next subsequent product 47 on the delivery member is automatically conveyed to the first end thereof, following retraction of the piston 70*a*, and is ready to be moved through the inlet port into the shell 14. Similarly, each time a product 47 is pushed by piston 70*a* through the inlet port 46 into the outer longitudinal channel section 45, the forward end 80 of that product engages, abuts or contacts the rearward end 80' of the next preceding product and thereby pushes the next preceding product into the outer end of the outer transverse channel section 43.

Once the lead product 47 has arrived at the outer end of the outer transverse channel section 43, the actuator 66*b* is actuated, individually or simultaneously with actuators 66*d* and 66*f*, to push the lead product toward the inner end of the outer transverse channel section 43 whereby the lead product is advanced to the next position in channel 41. The next time that the actuator 66*a* is actuated following retraction of piston 70*b*, the product that is next subsequent to the lead product is moved from the outer longitudinal channel section 45 into the outer end of the outer transverse channel section 43. When the actuator 66*b* is thereafter actuated individually or simultaneously with actuators 66*d* and 66*f*, following retraction of piston 70*a* and piston 70*c* (if previously extended), the next subsequent product disposed at the outer end of outer transverse channel section 43 is pushed by piston 70*b*. The inner side 78' of the next subsequent product engages, abuts or contacts the outer side 78 of the lead product and moves the lead product into the inner end of the outer transverse channel section 43.

Following retraction of piston 70*b*, the actuators 66*a* and 66*c* are actuated simultaneously, with or without simultaneous actuation of actuators 66*e* and 66*g*, to push another subsequent product from the first end of the delivery member 60 through the inlet port 46 into the outer longitudinal channel section 45 and to simultaneously push the lead product disposed at the inner end of outer transverse channel section 43 into the first end of the inner longitudinal channel section 42. As the another subsequent product is moved through the inlet port into the outer longitudinal channel section 45, the product next preceding thereto is moved from the outer longitudinal channel section 45 into the outer end of outer transverse channel section 43 via abutment of the forward end of the another subsequent product with the rearward end of the product next preceding thereto.

The actuator 66*b* is actuated, individually or simultaneously with actuators 66*d* and 66*f*, following retraction of pistons 70*a* and 70*c*. As a result thereof, the product disposed at the outer end of the outer transverse channel section 43 is pushed by piston 70*b* and is advanced a single increment. As the product disposed at the outer end of the outer transverse channel section 43 is advanced by piston 70*b*, its inner side 78' engages, contacts or abuts the outer side 78 of the next preceding product, which is next subsequent to the lead product. Accordingly, the product that is next subsequent to the lead product is moved into the inner end of the outer transverse channel section 43. The actuators 66*a* and 66*c* continue to be actuated simultaneously, with or without simultaneous actuation of actuators 66*e* and 66*g*, in alternating sequence with actuation of actuator 66*b*, with or without simultaneous actuation of actuators 66*d* and 66*f*. In this manner, products 47 continue to be advanced a single position or increment in channel 41. Once six products 47 are disposed in inner longitudinal channel section 42, the lead product disposed at the second end thereof is moved into the outer end of inner transverse channel section 44 the next time the actuators 66*a* and 66*c* are simultaneously actuated, with or without simultaneous actuation of actuators 66*e* and 66*g*.

Once the lead product has been moved from the second end of the inner longitudinal channel section 42 into the outer end of inner transverse channel section 44, actuator 66*d* is actuated simultaneously with actuator 66*b*, with or without simultaneous actuation of actuator 66*f*, following retraction of pistons 70*a* and 70*c*. Actuation of actuator 66*d* causes the product at the outer end of inner transverse channel section 44, i.e. the lead product, to be moved into the opposite, outer end of the inner transverse channel section 44. Simultaneous actuation of actuator 66*b* therewith causes a most preceding product in the outer transverse channel section 43 to be moved into the inner end thereof. Following return of pistons 70*b* and 70*d* to the retracted position, actuator 66*e* is actuated simultaneously with actuators 66*a* and 66*c*, with or without simultaneous actuation of actuator 66*g*. The lead product is moved by actuator 66*e* from the opposite, outer end of inner transverse channel section 44 into the second end of the inner longitudinal channel section 42'. Simultaneously therewith, a new subsequent product is pushed by actuator 66*a* through the inlet port 46 into the outer longitudinal channel section 45 causing the product next preceding thereto to be moved into the outer end of the outer transverse channel section 43. In addition, a product disposed at the inner end of the outer transverse channel section 43 is simultaneously pushed by actuator 66*c* into the first end of inner longitudinal channel section 42 causing a product disposed at the second end of the inner longitudinal channel section, i.e. the product next subsequent to the lead product, to be moved into the outer end of the inner transverse channel section 44.

The actuators 66*b* and 66*d* are actuated simultaneously, with or without actuation of actuator 66*f*, in alternating sequence with simultaneous actuation of actuators 66*a*, 66*c* and 66*e*, with or without actuation of actuator 66*g*, such that six products will be disposed in inner longitudinal channel section 42' in end to end relation, with the lead product 47 disposed at the first end of the inner longitudinal channel section 42'. The next time actuators 66*a*, 66*c* and 66*e* are simultaneously actuated, the lead product 47 is moved into the inner end of the outer transverse channel section 43'.

Once the lead product 47 has been moved from the inner longitudinal channel section 42' into the inner end of outer transverse channel section 43', the actuator 66*f* is actuated simultaneously or in unison with actuators 66*b* and 66*d*. The lead product 47 disposed at the inner end of outer transverse channel section 43' is pulled by piston 70*f* toward the outer end of outer transverse channel section 43'. Simultaneously therewith, the product at the outer end of outer transverse channel section 43 is advanced a single increment by piston 70*b* and the product at the outer end of inner transverse channel section 44 is moved to the opposite, outer end thereof by piston 70*d*. When the actuators 66*a*, 66*c* and 66*e* are thereafter actuated simultaneously, the product that is next subsequent to the lead product is moved from the inner longitudinal channel section 42' into the inner end of outer transverse channel section 43', the product at the second end of inner longitudinal channel section 42 is moved into the outer end of inner transverse channel section 44 and the product in the outer longitudinal channel section 45 is moved into the outer end of outer transverse channel section 43.

The next time actuators 66*b*, 66*d* and 66*f* are simultaneously actuated, the lead product 47 disposed in outer transverse channel section 43' is moved into the outer end of outer transverse channel section 43, the product next subsequent to the lead product is pulled by piston 70*f* a single increment, the product at the outer end of inner transverse channel section 44 is pushed by piston 70*d* to the opposite, outer end thereof, the product at the outer end of outer transverse channel section 43 is pushed by piston 70*d* a single increment and the product next preceding thereto is moved into the inner end of outer transverse channel section 43. The actuators 66*a*, 66*c*, 66*e* and 66*g* are thereafter actuated simultaneously or in unison. As a result thereof, the lead product 47 at the outer end of outer transverse channel section 43' is pushed by piston 70*g* into the outer longitudinal channel section 45'. In addition, the products in outer longitudinal channel section 45 and inner longitudinal channel sections 42 and 42' are each advanced a single position or increment as previously described. The actuators 66*b*, 66*d* and 66*f* are thereafter simultaneously actuated to advance the products in the outer transverse channel sections 43 and 43' and the inner transverse channel section 44 as described above.

The next time actuators 66*a*, 66*c*, 66*e* and 66*g* are actuated simultaneously, the product that is disposed in the outer end of the outer transverse channel section 43' is moved therefrom into the outer longitudinal channel section 45' causing movement of the next preceding product, i.e. the lead product 47, through the outlet port 46' for discharge onto the first end of the discharge member 64. Simultaneously therewith, the products within the outer longitudinal channel section 45 and the inner longitudinal channel sections 42 and 42' are incrementally advanced as described above. The lead product 47 discharged onto the first end of the discharge member 64 is automatically conveyed, by gravity, toward the second end of the discharge member 64 for removal therefrom. As a result of continuous supply of products to the delivery member and continuous actuation or operation of actuators 66*a*, 66*c*, 66*e* and 66*g* in alternation with actuators 66*b*, 66*d* and 66*f*, the products 47 are continuously introduced in, advanced through and discharged from the product irradiation device 10.

Once the lead product has been discharged from the product irradiation device, initial start up will be completed. The transport channel will be filled to capacity with products to be irradiated, and normal operation of the product irradiation device will ensue. When the product irradiation device is to be shut down following establishment of normal operation, dummy products, similar in size and shape to the actual products 47, are sequentially introduced and advanced in the transport channel in place of the actual products 47 until the last actual product 47 has been discharged therefrom. The transport channel will then be filled to capacity with dummy products, such as empty boxes, and the product irradiation device will be ready for shut down, which would typically occur during the third daily operating shift.

When the product irradiation device is thereafter restarted, typically at the beginning of the first daily operating shift, actual products 47 are introduced in and advanced through the transport channel, and the dummy products discharged from the device are retrieved. The retrieved dummy products can be saved for reuse. Once the last dummy product has been discharged from the product irradiation device, normal operation of the product irradiation device will ensue.

As the products 47 are moved through the transport channel 41, they are moved past the irradiation source 49. In particular, the products 47 are moved past the irradiation source 49 as they are moved through inner longitudinal channel sections 42 and 42', i.e. the high radiation zone. The products 47 have their external dimension D1 disposed parallel to plane P1 and, therefore, the irradiation source 49, as they enter, move through and are discharged from the shell 14. The inner side 78' of the products 47 faces the irradiation source 49 as the products move through the inner longitudinal channel section 42, and the outer side 78 of the products faces the irradiation source 49 as the products move through the inner longitudinal channel section 42'. The outer and inner sides 78 and 78' that face the irradiation source 49 during movement of the products 47 through the shell 14 constitute the major external dimension for the products 47 such that a major or maximum area or part of the products is exposed to the maximum radiation. Each product 47 has its lower side 79' in direct contact with the transport surface 48, i.e. the interior surface of lower wall 35. As the products 47 enter, move through and are discharged from the transport channel 41, the lower sides 79' remain in contact with the transport surface 48. The parallel orientation of the major axis or external dimension D1 with the plane P1 as the products enter, move through and are discharged from the shell 14 is maintained by the close correspondence of the cross-sectional size and configuration of the transport channel 41 to the external cross-sectional sizes and configurations of the products. Accordingly, as the products are moved through the shell, opposite sides of the products are irradiated without requiring rotation of the products or other undesired displacement of the products from their parallel orientation with plane P1.

The products 47 enter the shell 14 on one side of the enclosure 12 and are discharged from the shell 14 on an opposite side of the enclosure 12. In particular, the products 47 enter the enclosure 12 at a location disposed on side wall 17 and exit the enclosure 12 at a location disposed on the side wall 17'. Accordingly, the products 47 enter and exit the product irradiation device 10 at different, remote locations such that nonirradiated products entering the product irradiation device 10 should not become confused or intermingled with irradiated products exiting the product irradiation device 10.

In the preferred method of irradiating products, the actuators 66*a,* 66*c,* 66*e* and 66*g* are actuated simultaneously in alternating sequence with simultaneous actuation of actuators 66*b,* 66*d* and 66*f* in ten second intervals. Accordingly, ten seconds after the pistons 70*a,* 70*c,* 70*e* and 70*g* are simultaneously extended, the pistons 70*b* and 70*d* are simultaneously extended and the piston 70*f* is retracted simultaneously with extension of pistons 70*b* and 70*d*. The pistons 70*a,* 70*c,* 70*e* and 70*g* are again simultaneously extended ten seconds after simultaneous extension of pistons 70*b* and 70*d* and retraction of piston 70*f,* and so on. A new product 47 will enter the shell 14 every ten seconds, and each product will spend approximately three minutes in the shell 14 passing through the transport channel 41. It should be appreciated, however, that the speed of movement of the products through the transport channel can be adjusted by adjusting the intervals at which new products are introduced in the transport channel and by adjusting the timing for extension and retraction of the pistons. For example, it may be desirable to decrease the speed of the products through the transport channel to increase the dosage of radiation imparted to the products. The speed of the products may also be adjusted to account for decay of the irradiation source. For example, the speed of products through the shell may be decreased to offset radioactive decay of rods 50.

In an alternative embodiment, the shell 14 can be rotated, as shown by the arrow 84 in FIG. 2, 90 degrees from the position shown in FIG. 2. The upper and lower walls 34 and 35, respectively, will then define side walls for the shell 4, the side wall 36, side wall segment 39 and end wall 40 will define an upper wall for the shell 14, and the side wall 36', side wall segment 39' and end wall 40' will define a lower wall for the shell 14. In this orientation, the inlet port 46 will be disposed along a top of the shell 14, and the outlet port 46' will be disposed along a bottom of the shell 14. Of course, the delivery and discharge members can be modified, as necessary, to permit gravity conveyance of products to the inlet port 46 and gravity conveyance of products away from the outlet port 46'. Where the shell 14 is rotated 90 degrees, a suitable enclosure for the shell can be provided, the enclosure having entry and exit openings establishing communication with the inlet and outlet ports, respectively, from externally of the enclosure.

By rotating the shell 90°, the plane P1 of the irradiation source will be oriented horizontally rather than vertically as in the case of shell 14. In this manner, products will pass above and below the irradiation source rather than passing the irradiation source on opposite sides thereof as in the case of product irradiation device 10. In order to illustrate this arrangement, FIG. 3 can be considered representative of a side view of a modified shell that has been rotated 90° and, in particular, a side view of shell 14 rotated 90°. When thusly rotated, the shell 14 can be modified so that the inlet port 46 and the outlet port 46' are not located at the top and bottom, respectively, of the shell. For example, it may be desirable for the inlet and outlet ports 46 and 46' to be disposed on opposite sides of or on the same side of the shell. Accordingly, as an example, the outer longitudinal channel section 45 and the outer transverse channel section 43 can be disposed in the same plane or at the same elevation as the inner longitudinal channel section 42 so that the transport surfaces of the outer longitudinal channel section 45, the outer transverse channel section 43 and the inner longitudinal channel section 42 are all disposed in the same plane, such plane being parallel to the plane P1 of the irradiation source. Similarly, the outer longitudinal channel section 45' and the outer transverse channel section 43' can be disposed in the same plane or at the same elevation as the inner longitudinal channel section 42' so that the transport surfaces of the outer longitudinal channel section 45', the outer transverse channel section 43' and the inner longitudinal channel section 42' are all disposed in the same plane, such plane being parallel to the plane P1 of the irradiation source and the plane containing the transport surfaces of channel sections 42, 43 and 45. With this approach, vertical lowering of the products is needed at only one location in that the products would only need to be vertically lowered from the outer end to the inner end of the inner transverse channel section 44, the outer and inner ends of channel section 44 now being upper and lower ends thereof since the channel section 44 is oriented vertically due to rotation of the shell 14 by 90°.

The modified shell design discussed above is particularly amenable to irradiating relatively small objects or packages contained in baskets. The modified shell design allows products to be transported through the shell with bottoms, rather than sides, of the products, such as bottoms of the baskets, disposed and supported on the transport surface, thusly minimizing concerns with product shifting within containers, boxes or baskets as could occur when the containers, boxes or baskets are supported or placed on their sides when passing through the transport channel. In the modified shell design, the inlet and outlet ports may be located on the same side of the shell in order to minimize total width of the device.

No moving mechanical parts are disposed in the high radiation zone of the shell 14 which would require access to the interior of the shell 14 in order to perform maintenance and/or repair. The pistons 70 are disposed outside of or beyond the high radiation zone. Each of the cylinders 68 is mounted externally of the transport channel 41, either on, to or within the walls of the shell, allowing the actuators to be accessed externally of the shell interior in order to perform maintenance and/or repair. The actuators are simple linear devices that are easily removable and replaceable for maintenance without removing the irradiation source from the device. The transport surface 48, upon and along which the products are moved, is formed by an interior surface or surfaces of the shell 14 without requiring any moving support surfaces or parts. The products are irradiated at the processing or manufacturing facility or other source thereof and are ready for transport or distribution immediately upon discharge from the irradiation device. The prescribed path for the products through the shell is uncomplicated and eliminates or reduces the risk of malfunction and/or damage to the products being irradiated. Human operation or intervention is greatly minimized in that irradiation is accomplished automatically once the control system has been set to select a desired automatic, timed operation for the actuators. Various natural or artificially created products can be irradiated with the product irradiation device.

The irradiator shell 14 and the arrangement of the prescribed path therethrough allow the size of the irradiator shell to be minimized for reduced cost and material needs. The actuators are simple and uncomplicated and are compatible for use with various types of products to be irradiated. The strokes or extensions of the pistons can vary in accordance with the dimensions of the products and the distance that the products must be moved in the transport channel. The size and configuration of the inlet and outlet ports may closely correspond to the size and configuration of the products to minimize excess space or gaps at the inlet and outlet ports. The size and configuration of the inlet and outlet ports as well as the cross-sectional size and configuration of the transport channel are preferably no larger than necessary to accommodate the products therein so as to eliminate or greatly reduce the risk of inadvertent human access to the interior of the shell. Accordingly, the inlet and outlet ports are sized to prevent or preclude human access passively, without any interlocks and/or opening/closing mechanisms. The product engaging ends of the actuators can have various configurations in accordance with the characteristics of the products to be engaged thereby, and the product engaging ends may have planar or non-planar surfaces. Depending on the cross-sectional size of the transport channel, the product engaging ends do not have to be aligned or flush with or disposed within the walls of the shell in the retracted position but, rather, can protrude into the transport channel. The pistons of the actuators can be mounted for movement within the wall or walls of the shell with only the product engaging ends thereof protruding into the transport channel in the extended position to engage the products to be moved thereby.

The product irradiation device is intended to be fabricated offsite and can be assembled and tested prior to shipment to the site at which product irradiation is to take place. The product irradiation device can be shipped as two or more subassemblies, which are reassembled on site.

It should be appreciated that the subject invention is subject to various modifications, variations and changes in detail. Accordingly, the foregoing description of the preferred embodiments should be considered illustrative only and should not be taken in a limiting sense.

What is claimed is:

1. A product irradiation device for irradiating products comprising a transportable enclosure defining an interior and having an entry opening through which products enter said enclosure and having an exit opening through which the products exit said enclosure;

an irradiator shell disposed in said interior and comprising a wall enclosing an irradiation source and a transport channel, said transport channel having an inlet port, disposed along an exterior surface of said wall, communicating with said entry opening by which the products enter said transport channel and having an outlet port, disposed along an exterior surface of said wall, communicating with said exit opening by which the products are discharged from said transport channel, said transport channel defining a prescribed path for the products through said shell and past said irradiation source, said outlet port being spaced from said inlet port, said transport channel including a transport surface upon which the products are supported in contact with said transport surface and are moved in said prescribed path from said inlet port to said outlet port, said transport surface being formed by an interior surface of said wall, said interior surface being non-moving from said inlet port to said outlet port; and a plurality of linear actuators mounted to said shell for moving the products into, through and out of said transport channel whereby the products are moved in said prescribed path past said irradiation source and are thereby irradiated prior to being discharged through said outlet port.

2. A product irradiation device as recited in claim 1 wherein said inlet and outlet ports are disposed in a plane and said irradiation source includes a plurality of rods of radioactive material arranged in said shell to be disposed in a plane perpendicular to said plane of said inlet and outlet ports.

3. A product irradiation device as recited in claim 2 wherein said inlet port is disposed on one side of said plane of said rods and said outlet port is disposed on an opposite side of said plane of said rods.

4. A product irradiation device as recited in claim 1 wherein said transport channel is adapted to receive the products therein with a side of each of the products in contact with said transport surface as the products are moved through said transport channel.

5. A product irradiation device as recited in claim 1 wherein said transport channel is adapted to receive the products therein with a bottom of each of the products in contact with said transport surface as the products are moved through said transport channel.

6. A product irradiation device as recited in claim 2 wherein said transport channel includes inner longitudinal channel sections disposed on opposite sides of said plane of said rods, said inner longitudinal channel sections being parallel to said plane of said rods, said rods being disposed in linear series between said inner longitudinal channel sections, said inner longitudinal channel sections defining a high radiation zone within said shell, said actuators including slidably movable pistons, respectively, movable between extended and retracted positions to move the products into, through and out of said transport channel, said pistons being disposed outside of said high radiation zone such that no moving mechanical parts are disposed in said high radiation zone.

7. A product irradiation device as recited in claim 6 wherein the products have an external longitudinal dimension and said actuators move the products into, through and out of said transport channel with the external longitudinal dimension disposed parallel to said plane of said rods.

8. A product irradiation device as recited in claim 1 wherein said irradiation source includes a plurality of rods of radioactive material arranged in said shell to be disposed in a plane and said transport surface is planar and perpendicular to said plane of said rods.

9. A product irradiation device as recited in claim 1 wherein said irradiation source includes a plurality of rods of radioactive material arranged in said shell to be disposed in a plane and said transport surface is planar and parallel to said plane of said rods.

10. A product irradiation device as recited in claim 1 wherein the products have an external cross-section and said transport channel has a cross-section closely corresponding to the external cross-section of the products.

11. A product irradiation device as recited in claim 10 wherein said cross-section of said transport channel is non-uniform between said inlet port and said outlet port.

12. A product irradiation device as recited in claim 1 wherein said irradiation source is disposed in a plane and said inlet and outlet ports are disposed in a plane perpendicular to said plane of said irradiation source, said transport channel includes a first outer longitudinal channel section extending longitudinally from said inlet port in a direction parallel to said plane of said irradiation source, a first outer transverse channel section having an outer end communicating with said first outer longitudinal channel section, said first outer transverse channel section extending longitudinally in a direction perpendicular to said plane of said irradiation source from said outer end to an inner end of said first transverse channel section, a first inner longitudinal channel section having a first end communicating with said inner end of said first outer transverse channel section, said first inner longitudinal channel section extending longitudinally in a direction parallel to said plane of said irradiation source from said first end to a second end of said first inner longitudinal channel section, an inner transverse channel section having an outer end communicating with said second end of said first inner longitudinal channel section, said inner transverse channel section extending longitudinally in a direction perpendicular to said plane of said irradiation source from said outer end of said inner transverse channel section to an opposite outer end of said inner transverse channel section, a second inner longitudinal channel section having a second end communicating with said opposite outer end of said inner transverse channel section, said second inner longitudinal channel section being parallel to said first inner longitudinal channel section and extending longitudinally in a direction parallel to said plane of said irradiation source from said second end of said second inner longitudinal channel section to a first end of said second inner longitudinal channel section, a second outer transverse channel section parallel to said inner transverse channel section and having an inner end communicating with said first end of said second inner longitudinal channel section, said second outer transverse channel section extending longitudinally in a direction perpendicular to said plane of said irradiation source from said inner end of said second outer transverse channel section to an outer end of said second outer transverse channel section and a second outer longitudinal channel section parallel to said first outer longitudinal channel section and extending longitudinally in a direction parallel to said plane of said irradiation source from said outer end of said second outer transverse channel section to said outlet port, said plane of said irradiation source being disposed between said first and second inner longitudinal channel sections.

13. A product irradiation device as recited in claim 12 wherein a first one of said actuators pushes the products, in a direction parallel to said plane of said irradiation source, through said inlet port into and through said first outer longitudinal channel section into said outer end of said first outer transverse channel section, a second one of said actuators pushes the products, in a direction perpendicular to said plane of said irradiation source, from said outer end of said first outer transverse channel section into said inner end of said first outer transverse channel section, a third one of said actuators pushes the products, in a direction parallel to said plane of said irradiation source, from said inner end of said first outer transverse channel section into and through said first inner longitudinal channel section into said outer end of said inner transverse channel section, a fourth one of said actuators pushes the products, in a direction perpendicular to said plane of said irradiation source, from said outer end of said inner transverse channel section into said opposite outer end of said inner transverse channel section, a fifth one of said actuators pushes the products, in a direction parallel to said plane of said irradiation source, from said opposite outer end of said inner transverse channel section into and through said second inner longitudinal channel section into said inner end of said second outer transverse channel section, a sixth one of said actuators pulls the products, in a direction perpendicular to said plane of said irradiation source, from said inner end of said second outer transverse channel section into said outer end of said second outer transverse channel section and a seventh one of said actuators pushes the products, in a direction parallel to said plane of said irradiation source, from said outer end of said second outer transverse channel section into and through said second outer longitudinal channel section and through said outlet port.

14. A product irradiation device as recited in claim 13 wherein the products are moved in the same perpendicular direction within said first and second outer transverse channel sections and said inner transverse channel section, the products are moved in the same parallel direction within said first outer longitudinal channel section and said second inner longitudinal channel section, and the products are moved in the same parallel direction within said first inner longitudinal channel section and said second outer longitudinal channel section, the products being moved within said first inner longitudinal channel section and said second outer longitudinal channel section in a parallel direction opposite the parallel direction of movement of the products within said first outer longitudinal channel section and said second inner longitudinal channel section.

15. A product irradiation device as recited in claim 14 wherein said actuators include cylinders, respectively, and pistons, respectively, longitudinally movable within said cylinders between retracted positions and extended positions, respectively, said pistons of said first one of said actuators being disposed externally of said shell in longitudinal alignment with said inlet port whereby a product is capable of being positioned in front of said inlet port in longitudinal alignment therewith when said piston is in said retracted position and is pushed by said piston through said inlet port into said first outer longitudinal channel section when said piston is moved to said extended position, said piston of said second one of said actuators being longitudinally aligned with said outer end of said first outer transverse channel section whereby a product is capable of being moved from said first outer longitudinal channel section into said outer end of said first outer transverse channel section when said piston of said second one of said actuators is in said retracted position and is pushed by said piston of said second one of said actuators from said outer end of said first outer transverse channel section toward said inner end of said first outer transverse channel section when said piston of said second one of said actuators is moved to said extended position, said piston of said third one of said actuators being longitudinally aligned with said first inner longitudinal channel section whereby a product is capable of being moved into said inner end of said first outer transverse channel section when said piston of said third one of said actuators is in said retracted position and is pushed by said piston of said third one of said actuators from said inner end of said first outer transverse channel section into said first end of said first inner longitudinal channel section when said piston of said third one of said actuators is moved to said extended position, said piston of said fourth one of said actuators being longitudinally aligned with said outer end of said inner transverse channel section whereby a product is capable of being moved from said second end of said first inner longitudinal channel section into said outer end of said inner transverse channel section when said piston of said fourth one of said actuators is in said retracted position and is pushed by said piston of said fourth one of said actuators from said outer end of said inner transverse channel section into said opposite outer end of said inner transverse channel section when said piston of said fourth one of said actuators is moved to said extended position, said piston of said fifth one of said actuators being longitudinally aligned with said second end of said second inner longitudinal channel section whereby a product is capable of being moved into said opposite outer end of said inner transverse channel section when said piston of said fifth one of said actuators is in said retracted position and is pushed by said piston of said fifth one of said actuators from said opposite outer end of said inner transverse channel section into said second end of said second inner longitudinal channel section when said piston of said fifth one of said actuators is moved to said extended position, said piston of a sixth one of said actuators being longitudinally aligned with said outer end of said second outer transverse channel section whereby a product is capable of being moved from said first end of said second inner longitudinal channel section into said inner end of said second outer transverse channel section when said piston of said sixth one of said actuators is in said extended position and is pulled by said piston of said sixth one of said actuators from said inner end of said second outer transverse channel section toward said outer end of said second outer transverse channel section when said piston of said sixth one of said actuators is moved to said retracted position, and said piston of said seventh one of said actuators being longitudinally aligned with said second outer longitudinal channel section whereby a product is capable of being moved into said outer end of said second outer transverse channel section when said piston of said seventh one of said actuators is in said retracted position and is pushed by said piston of said seventh one of said actuators from said outer end of said second outer transverse channel section into said second outer longitudinal channel section when said piston of said seventh one of said actuators is moved to said extended position.

16. A product irradiation device as recite in claim 15 wherein said first, third, fifth and seventh ones of said actuators are adapted to be actuated simultaneously and said second, fourth and sixth ones of said actuators are adapted to be actuated simultaneously in alternating sequence with simultaneous actuation of said first, third, fifth and seventh ones of said actuators.

17. A product irradiation device as recited in claim 16 wherein said pistons include product engaging ends, respectively, for engaging the products, respectively, moved thereby.

18. A product irradiation device as recited in claim 1 wherein said irradiation source includes a plurality of rods of radioactive material and said rods are capable of being safely removed from and inserted in said shell while the products are being moved through said transport channel.

19. A product irradiation device as recited in claim 1 wherein said actuators are hydraulic actuators.

20. A product irradiation device as recited in claim 1 wherein said actuators are pneumatic actuators.

21. A product irradiation device as recited in claim 1 and further including a delivery member extending through said entry opening when said entry opening is open for supplying the products to said shell and having a first end communicating with said inlet port and a second end disposed externally of said enclosure and a discharge member extending through said exit opening when said exit opening is open for transporting the products away from said shell after being discharged from said outlet port and having a first end communicating with said outlet port and a second end disposed externally of said enclosure.

22. A product irradiation device for irradiating products comprising an irradiator shell comprising a wall enclosing an irradiation source and a transport channel defining a prescribed path within said shell past said irradiation source, said wall having an inlet port therein communicating with said transport channel by which products, prior to being irradiated, enter said transport channel and having an outlet port therein communicating with said transport channel by which products, subsequent to being irradiated, are discharged from said transport channel, said transport channel including a solid transport surface upon which the products are supported in contact with said transport surface and are moved in said prescribed path from said inlet port to said outlet port, the solidity of said solid transport surface being continuous and without interruption from said inlet port to said outlet port;

a plurality of actuators mounted to said shell for moving the products into, through and out of said transport channel whereby the products are moved in said prescribed path past said irradiation source and are thereby irradiated prior to being discharged through said outlet port; and a transportable enclosure defining an interior receiving said shell, said enclosure including an upper wall, a lower wall upon which said shell is supported, a pair of opposing side walls and a pair of end walls together defining said interior, said enclosure having an entry opening through which the products, prior to being irradiated, enter said inlet port of said shell and having an exit opening through which the products, subsequent to being irradiated, exit said enclosure after being discharged through said outlet port of said shell, said entry opening being separate from said exit opening to avoid intermingling of non-irradiated and irradiated products.

23. A product irradiation device as recited in claim 22 wherein said entry opening is disposed along one of said side walls of said enclosure and said exit opening is disposed along the other of said side walls of said enclosure.

24. A product irradiation device as recited in claim 23 wherein said inlet port is separate from said outlet port.

25. A product irradiation device as recited in claim 22 and further including a plurality of wheels upon which said enclosure is mounted for transport along the ground.

26. A product irradiation device as recited in claim 22 and further including an HVAC module on said enclosure adapted to effect heating, ventilation and cooling of said interior.

27. A product irradiation device as recited in claim 26 and further including a generator module on said enclosure adapted to provide electric power for said enclosure.

28. A product irradiation device as recited in claim 22 wherein said entry opening is defined by at least one first door on said enclosure and said exit opening is defined by at least one second door on said enclosure.

29. A product irradiation device as recited in claim 28 wherein said enclosure is a truck trailer.

30. A product irradiation device as recited in claim 22 wherein said transport surface is made of stainless steel.

31. A product irradiation device as recited in claim 22 and further including a delivery member extending through said entry opening when said entry opening is open and having a first end removably disposed in communication with said inlet port and a second end disposed at a location proximate a source of the products, said delivery member being adapted to passively convey the products from said second end to said first end thereof, and a discharge member extending through said exit opening when said exit opening is open and having a first end removably disposed in communication with said outlet port and a second end disposed at a different location proximate the source of the products, said discharge member being adapted to passively convey the products discharged through said outlet port to said second end of said discharge member.

32. A product irradiation device as recited in claim 31 wherein said delivery member and said discharge member are roller ramps, respectively, positioned at angles, respectively, to said enclosure for conveying the products therealong by gravity.

33. A method of irradiating products comprising the steps of introducing products, prior to being irradiated, in succession through an inlet port of an irradiator shell and into a transport channel of the irradiator shell such that the products are supported upon and in contact with a transport surface of the shell which is non-moving from the inlet port to an outlet port of the shell;

moving the products relative to and upon the transport surface in fixed increments such that the products are moved through the transport channel past an irradiation source within the shell and are thereby irradiated, said step of moving including moving the products from the inlet port to the outlet port while the products remain supported upon and in contact with the transport surface; and discharging the products, subsequent to being irradiated, in succession through the outlet port of the irradiator shell disposed at a location different from the inlet port.

34. A method of irradiating products as recited in claim 33 wherein said step of introducing includes continuously introducing products in succession through the inlet port and said step of discharging includes continuously discharging products in succession from the outlet port.

35. A method of irradiating products as recited in claim 34 wherein the irradiation source is disposed in a plane and said steps of introducing, moving and discharging include introducing, moving and discharging the products with a major dimension of the products disposed parallel to the plane of the irradiation source.

36. A method of irradiating products as recited in claim 35 wherein said steps of introducing, moving and discharging include introducing, moving and discharging the products with the length of the products disposed parallel to the plane of the irradiation source.

37. A method of irradiating products as recited in claim 36 wherein said step of moving includes moving the products in the transport channel with the products directly supported upon the transport surface.

38. A method of irradiating products as recited in claim 37 wherein said step of moving includes actuating a plurality of linear actuators to extend and retract pistons, respectively, of the actuators to advance the products through the transport channel in the fixed increments.

39. A method of irradiating products as recited in claim 38 wherein the transport channel includes first and second inner longitudinal channel sections parallel to the plane of the source and between which the irradiation source is disposed, an inner transverse channel section, perpendicular to the plane of the irradiation source, extending between ends of the first and second inner longitudinal channel sections, respectively, first and second outer longitudinal channel sections, parallel to the plane of the irradiation source, between which the first and second inner longitudinal channel sections are disposed and first and second outer transverse channel sections, perpendicular to the plane of the irradiation source, extending between opposite ends of the first and second inner longitudinal channel sections and the first and second outer longitudinal channel sections, respectively, and said step of moving includes moving products disposed in the first and second inner and outer longitudinal channel sections simultaneously in a direction parallel to the plane of the irradiation source and moving products disposed in the inner transverse channel section and the first and second outer transverse channel sections simultaneously in a direction perpendicular to the plane of the irradiation source in alternating sequence with simultaneous movement of the products in the first and second inner and outer longitudinal channel sections.

40. A method of irradiating products as recited in claim 39 wherein said step of moving includes simultaneously actuating some of the actuators to simultaneously move the products in the first and second inner and outer longitudinal channel sections, respectively, and simultaneously actuating others of the actuators to simultaneously move the products in the inner transverse channel section and the first and second outer transverse channel sections, respectively, in alternating sequence with simultaneous actuation of the some of the actuators.

41. A method of irradiating products as recited in claim 40 wherein said step of actuating includes moving the pistons of the some of the actuators, respectively, between a retracted position and an extended position, respectively, to push the products in the first and second inner and outer longitudinal channel sections, respectively, and alternately moving all except one of the pistons of the others of the actuators, respectively, between a retracted and an extended position, respectively, to push the products in the inner transverse channel section and the first outer transverse channel section simultaneously with moving the one of the pistons of the others of the actuators between an extended position and a retracted position to pull the products in the second outer transverse channel section.

42. A method of irradiating products as recited in claim 41 wherein the irradiator shell is disposed within an enclosure, said step of introducing includes introducing the products through an entry opening in the enclosure communicating with the inlet port of the irradiator shell and said step of discharging includes discharging the products through an exit opening of the enclosure communicating with the outlet port of the irradiator shell.

43. A method of irradiating products as recited in claim 42 wherein said step of introducing includes passively conveying the products along a delivery member extending through the entry opening of the enclosure and having a first end disposed adjacent the inlet port of the irradiator shell and a second end disposed externally of the enclosure and said step of discharging includes passively conveying the products along a discharge member extending through the exit opening of the enclosure and having a first end adjacent the outlet port of the irradiator shell and a second end disposed externally of the enclosure.

44. A method of irradiating products comprising the steps of mounting an irradiator shell in a transportable enclosure having an entry access opening in communication with an inlet port of the shell and having an exit access opening in communication with an outlet port of the shell;

transporting the enclosure to a source of products to be irradiated;

coupling a delivery member with the inlet port such that the delivery member extends through the entry access opening with a first end of the delivery member in external alignment with the inlet port and a second end of the delivery member disposed externally of the enclosure;

coupling a discharge member with the outlet port such that the discharge member extends through the exit access opening with a first end of the discharge member in external alignment with the outlet port and a second end of the discharge member disposed externally of the enclosure;

passively conveying the products to be irradiated in series along the delivery member from the second end to the first end thereof;

sequentially moving the products to be irradiated directly from the first end of the delivery member through the inlet port and onto and in contact with a non-moving transport surface within the shell extending continuously and without interruption from the inlet port to the outlet port;

moving the products to be irradiated in series relative to and along the non-moving transport surface past an irradiation source within the shell whereby the products are irradiated;

sequentially discharging the irradiated products directly from the non-moving transport surface through the outlet port and onto the first end of the discharge member; and passively conveying the irradiated products in series along the discharge member from the first end to the second end thereof.

45. The method of irradiating products recited in claim 44 wherein said step of coupling the delivery member includes coupling a delivery roller ramp with the inlet port, said step of passively conveying the products to be irradiated includes conveying the products to be irradiated along the delivery roller ramp by gravity, said step of coupling the discharge member includes coupling a discharge roller ramp with the outlet port and said step of passively conveying the irradiated products includes conveying the irradiated products along the discharge roller ramp by gravity.

46. The method of irradiating products recited in claim 44 wherein said step of moving includes moving the products through the shell with a major dimension of the products disposed parallel to a plane containing the irradiation source.

47. The method of irradiating products recited in claim 46 wherein said step of passively conveying the products to be irradiated includes passively conveying the products to be irradiated along the delivery member with the major dimension of the products disposed parallel to the plane containing the irradiation source, said step of sequentially moving includes moving the products to be irradiated from the delivery member into the shell with the major dimension of the products disposed parallel to the plane containing the irradiation source, said step of sequentially discharging includes discharging the irradiated products from the shell onto the discharge member with the major dimension of the products disposed parallel to the plane containing the irradiation source and said step of passively conveying the irradiated products includes passively conveying the irradiated products along the discharge member with the major dimension of the products disposed parallel to the plane containing the irradiation source.

* * * * *